US006013426A

United States Patent [19]

Ishii

[11] Patent Number: 6,013,426

[45] Date of Patent: Jan. 11, 2000

[54] SILVER HALIDE COLOR PHOTOGRAPHIC LIGHT-SENSITIVE MATERIAL

[75] Inventor: Yoshio Ishii, Minami-Ashigara, Japan

[73] Assignee: Fuji Photo Film Co., Ltd., Minami-Ashigara, Japan

[21] Appl. No.: 09/057,605

[22] Filed: Apr. 9, 1998

[30] Foreign Application Priority Data

Apr. 9, 1997 [JP] Japan ..... 9-105391

[51] Int. Cl.[7] ..... G03C 1/825; G03C 7/36

[52] U.S. Cl. ..... 430/507; 430/30; 430/510; 430/557; 430/944

[58] Field of Search ..... 430/507, 510, 430/944, 30, 557

[56] References Cited

U.S. PATENT DOCUMENTS

| | | | |
|---|---|---|---|
| 4,952,485 | 8/1990 | Shibahara et al. | 430/510 |
| 5,066,574 | 11/1991 | Kubota et al. | 430/557 |
| 5,278,039 | 1/1994 | Seto et al. | 430/557 |
| 5,498,515 | 3/1996 | Merkel et al. | 430/557 |
| 5,716,768 | 2/1998 | Maruyama et al. | 430/510 |
| 5,728,514 | 3/1998 | Yoshioka et al. | 430/557 |
| 5,821,042 | 10/1998 | Massirio et al. | 430/510 |
| 5,853,969 | 12/1998 | Harada et al. | 430/510 |

FOREIGN PATENT DOCUMENTS 8-179460 7/1996 Japan .

*Primary Examiner*—Richard L. Schilling
*Attorney, Agent, or Firm*—Birch, Stewart, Kolasch & Birch, LLP

[57] ABSTRACT

A silver halide color photographic light-sensitive material comprising at least one red-sensitive silver halide emulsion layer, at least one green-sensitive silver halide emulsion layer, at least one blue-sensitive silver halide emulsion layer and at least one hydrophilic colloidal layer containing black colloidal silver on a support, wherein a ratio A/T of a coating amount A ($g/m^2$) of black colloidal silver in the hydrophilic colloidal layer to a dry film thickness T ($\mu m$) of the hydrophilic colloidal layer containing black colloidal silver is 0.2 or more. In the silver halide color photographic light-sensitive material of the present invention, the minimum density (fog density) of a light-sensitive material is small and a change in photographic property in a running processing is small.

7 Claims, No Drawings

SILVER HALIDE COLOR PHOTOGRAPHIC LIGHT-SENSITIVE MATERIAL

BACKGROUND OF THE INVENTION

The present invention relates to a silver halide color photographic light-sensitive material and, more particularly, to a silver halide color photographic light-sensitive material wherein a variation in minimum density of a light-sensitive material is small and a change in photographic properties in a running processing is small.

With the recent progress of silver halide emulsifiers, it has become possible to obtain satisfactory sensitivity and image quality regardless of small total coating amount of silver of the light-sensitive material.

As the coating amount of silver of the light-sensitive material decreases in such way, there arises a problem that it becomes difficult to detect the light-sensitive material for the purpose of feeding the light-sensitive material in an automatic processor or a camera In case of the detection in the light-sensitive material of the automatic processor, infrared rays, which doe not cause exposure of the light-sensitive material, are used. It is considered that, when the total coating amount of silver is decreased, the transmittance of infrared rays due to the light-sensitive material increases (infrared density of the light-sensitive material is lowered), thereby making it difficult to detect the light-sensitive material.

JP-A-8-179460 ("JP-A" means Published Unexamined Japanese Patent Application) suggests a light-sensitive material wherein the total coating amount of silver, i.e. amount of metal silver is 3.2 g/m$^2$ or less and the infrared reflectance at 750 nm is defined as a means for improving the feeding property of the light-sensitive material of the camera, sharpness and desilvering capability.

When this light-sensitive material is used, the effect of improving the feeding property of the light-sensitive material of the camera, sharpness and desilvering capability is exerted, but an improvement of a change in photographic property in a running processing has been desired. In case of some cameras, accurate feeding can not be performed, rarely.

In order to increase the transmission density of infrared rays of the light-sensitive material, for example, the coating amount of black colloidal silver of an antihalation layer may be increased.

However, when the coating amount of black colloidal silver of the antihalation layer is increased, there is a fear of an increase in minimum density (fog density) after a developing processing, an increase in variation of the minimum density with a variation of a processing, and processing unevenness. Therefore, there was a demand for improvement.

BRIEF SUMMARY OF THE INVENTION

It is an object of the present invention to provide a silver halide color photographic light- sensitive material wherein a variation in minimum density (fog density) of a light-sensitive material is small and a change in photographic properties in a running processing is small.

It has been found the above object of the present invention can be achieved by the following means (1) to (3).

(1) A silver halide color photographic light-sensitive material comprising at least one red-sensitive silver halide emulsion layer, at least one green-sensitive silver halide emulsion layer, at least one blue-sensitive silver halide emulsion layer and at least one hydrophilic colloidal layer containing black colloidal silver on a support, wherein a ratio A/T of a coating amount A (g/m$^2$) of black colloidal silver in the hydrophilic colloidal layer to a dry film thickness T ($\mu$m) of the hydrophilic colloidal layer containing black colloidal silver is 0.2 to 6.

(2) The silver halide color photographic light-sensitive material described in item (1) above, wherein the hydrophilic colloidal layer containing black colloidal silver is disposed at closer position from the support than a color-sensitive layer next to the support among the red-sensitive silver halide emulsion layer, green-sensitive silver halide emulsion layer and blue-sensitive silver halide emulsion layer.

(3) The silver halide color photographic light-sensitive material described in item (1) or (2) above, which further contains a yellow coupler represented by Formula (I) below.

Formula (I)

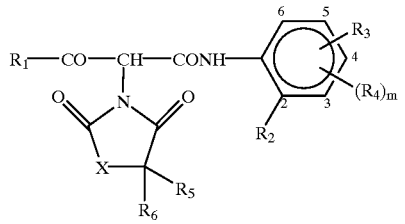

wherein $R_1$ represents a tertiary alkyl group, $R_2$ represents a halogen atom, an alkoxy group, an aryloxy group, an alkyl group, an alkylsulfonyloxy group or a cycloalkyl group, $R_3$ represents an alkoxycarbonyl group or an alkylsulfonyloxy group, $R_4$ represents a halogen atom, an alkyl group, an alkoxy group, a carbonamide group or a sulfonamide group, m represents an integer of 0 to 2, each of $R_5$ and $R_6$ independently represents a hydrogen atom or an alkyl group, X represents an oxygen atom, a sulfur atom or —N($R_{21}$)—, and $R_{21}$ represents a hydrogen atom, an alkyl group or an aryl group.

DETAILED DESCRIPTION OF THE INVENTION

The present invention will be described in more detail below.

First, black colloidal silver used in the present invention will be described.

As colloidal silver used in the silver halide color photographic light-sensitive material, yellow colloidal silver for yellow filter and black colloidal silver for antihalation are normally known. In the present invention, the effect of the present invention can be obtained by using black colloidal silver which is normally used for antihalation.

The term "black colloidal silver" used herein includes not only those wherein absorption at a visible range do not change substantially, but also brownish gray colloidal silver. That is, any one having an antihalation function can be used.

As a method of producing these colloidal silvers, there can be used methods which have hitherto been known, for example, a method of reducing a soluble silver salt in a gelatin solution with hydroquinone as described in U.S. Pat. No. 2,688,601; a method of reducing a slight soluble silver salt with hydrazine as described in German Patent 1,096,193; a method of reducing with tannic acid to form silver as described in U.S. Pat. No. 2,921,914; and a method of forming silver particles by electroless plating as described in JP-A-5-134358.

In the present invention, it is sufficient that if at least one "hydrophilic colloidal layer containing black colloidal silver" in the light-sensitive material satisfies $0.2 \leqq A/T \leqq 6$.

A method for measurement of a dry film thickness of the hydrophilic colloidal layer containing black colloidal silver referred in the present invention is as follows.

① A dry film thickness (a) of all light-sensitive materials including a support is measured.

② A dry film thickness of the support is measured after removing a coating on the side on which a light-sensitive emulsion layer is applied.

③ A total dry film thickness of a photographic layer at the side, on which a light-sensitive emulsion layer of a light-sensitive material is applied, determined by subtracting a value determined in item ② from that in item ①.

④ A total dry film thickness and a dry film thickness of a hydrophilic colloidal layer containing black colloidal silver are measured by observing using an electron microscope, and then a ratio of the dry thickness of the hydrophilic colloidal layer containing black colloidal silver to the total dry film thickness is determined.

⑤ The dry thickness of the hydrophilic colloidal layer containing black colloidal silver is determined by "total film thickness determined in item ③" x "ratio determined in item ④".

In the present invention, the ratio A/T of the coating amount A ($g/m^2$) of black colloidal silver in the hydrophilic colloidal layer to the dry film thickness T ($\mu m$) of the hydrophilic colloidal layer containing black colloidal silver is 0.2 or more, preferably 0.25 or more, and more preferably 0.3 or more. The higher the ratio A/T becomes, the better. A suitable amount of a binder is required to form a layer. Considering the amount of this binder, the upper limit for practical use is about 6.

The yellow coupler represented by Formula (I) above used preferably in the present invention will be described in detail below.

In Formula (I), $R_1$ is preferably a tertiary alkyl group having 4–16 carbon atoms, and may have a monocyclic or polycyclic structure or may have a substituent (e.g. halogen atom, aryl, alkoxy, and aryloxy). Specific examples of $R_1$ are t-butyl, 1-methylcyclopropan-1-yl, 1-ethylcyclopropan1-yl, 1-benzylcyclopropan-1-yl, 1-methylcyclobutan-1-yl, 1-methylcyclopentan-1-yl, 1-methylcyclohexan-1-yl, 2,2,5-trimethyl-1,3-dioxan-5-yl, bicyclo(2,1,0)pentan-1-yl, bicyclo(2,2,0)hexan-1-yl, bicyclo(3,1,0)hexan-1-yl, bicyclo(4,1,0)heptan-1-yl, bicyclo(1,1,1)pentan-1-yl, bicyclo(2,1,1)hexan-1-yl, bicyclo(2,2,1)heptan-1-yl, bicyclo(2,2,2)octan-1-yl, and adamantan-1-yl.

In Formula (I), $R_2$ is preferably a halogen atom (e.g. F, Cl, Br, and I), an alkoxy group having 1–24 carbon atoms (e.g. methoxy, butoxy, and tetradecyloxy), an aryloxy group having 6–24 carbon atoms (e.g. phenoxy, p-methoxyphenoxy, and p-t-octylphenoxy), an alkyl group having 1–8 carbon atoms (e.g. methyl, ethyl, isopropyl, t-butyl, benzyl, and trifluoromethyl), a cycloalkyl group having 3–8 carbon atoms (e.g. cyclopropyl, cyclopentyl, and cyclohexyl), or an alkylsulfonyloxy group having 1–24 carbon atoms (e.g. methylsulfonyloxy, and hexadecylsulfonyloxy).

In Formula (I), $R_3$ is preferably an alkoxycarbonyl or alkylsulfonyloxy group having 6–30 carbon atoms, and this alkyl group may contain an ether oxygen atom or an ester linkage. $R_3$ may have a substituent (e.g. halogen atom, aryl, and aryloxy). $R_3$ is preferably a group having a size enough to and a shape suited to impart nondiffusibility to the yellow coupler represented by Formula (I) in a hydrophilic colloid. The substitution position of $R_3$ is preferably 3-position, 4-position or 5-position on the benzene ring. Among them, 5-position is particularly preferable.

In Formula (I), $R_4$ is preferably a halogen atom (e.g. F, Cl, Br, and I), an alkyl group having 1–8 carbon atoms (e.g. methyl, isopropyl, and t-butyl), an alkoxy group having 1–8 carbon atoms (e.g. methoxy, butoxy, and benzyloxy), a carbonamide group having 1–8 carbon atoms (e.g. acetoamido, and benzamide), or a sulfonamide group having 1–8 carbon atoms (e.g. methanesulfoamide, and p-toluenesulfonamide).

In Formula (I), m is an integer of 0 to 2. When m is an integer of 1 or 2, the substitution position of $R_4$ is preferably 3-position, 4-position or 5-position on the benzene ring.

In Formula (I), $R_5$ and $R_6$ are independently and preferably a hydrogen atom or an alkyl group having 1–8 carbon atoms (e.g. methyl, ethyl, butyl, and hexyl).

In Formula (I), X is preferably an oxygen atom.

Particularly preferable embodiments in the coupler of the present invention are as follows.

That is, in Formula (I), $R_1$ is preferably t-butyl, 1-alkylcyclopropan-1-yl or 5-alkyl-1,3-dioxan-5-yl, more preferably t-butyl or 1-alkylcyclopropan-1-yl (the substituent, alkyl described as the specific examples of $R_1$ has 1 to 10 carbon atoms)

$R_2$ is a halogen atom (e.g. fluorine atom, and chlorine atom) or an alkoxy group having 1–20 carbon atoms.

$R_3$ is a straight-chain or branched alkyl group having 8–24 carbon atoms which may contain an ether oxygen atom or an ester linkage.

$R_4$ is a halogen atom (e.g. fluorine atom, and chlorine atom) or an alkoxy group.

m is an integer of 0 to 1. When m is 1, the substitution position of $R_4$ is preferably 3-position or 4-position.

$R_5$ and $R_6$ are independently a hydrogen atom or an alkyl group having 1–4 carbon atoms.

$R_{21}$ is a hydrogen atom, an alkyl group having 1–10 carbon atoms or an aryl group having 6–12 carbon atoms.

Among the couplers represented by Formula (I), a particularly preferable coupler is represented by Formula (III) below.

Formula (III)

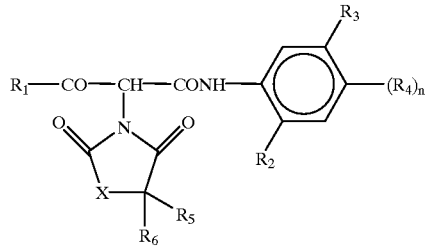

In Formula (III), $R_1$, $R_2$, $R_3$, $R_4$, $R_5$, $R_6$ and X respectively have the same meaning as $R_1$, $R_2$, $R_3$, $R_4$, $R_5$, $R_6$ and X in Formula (I) and n is an integer of 0 or 1.

Specific examples of the yellow coupler represented by Formula (III) used preferably in the present invention (hereinafter referred to as the "yellow coupler according to the present invention") are shown below. However, the present invention is not limited to these examples. Incidentally, the substitution position of $R_3$ and $R_4$ in the following table is based on Formula (I)

| No. | —$R_1$ | —$R_2$ | —$R_3$ (*) | m —$R_4$ (**) | —$R_5$ —$R_6$ | —X— |
|---|---|---|---|---|---|---|
| Y-1 | $(CH_3)_3C$— | —Cl | —$COOC_{14}H_{29}$-n (5) | 0 | —$CH_3$ —$CH_3$ | —NH— |
| Y-2 | $(CH_3)_3C$— | —Cl | —$COOC_{12}H_{25}$-n (5) | 0 | —$CH_3$ —$CH_3$ | —$NCH_3$— |
| Y-3 | $(CH_3)_3C$— | —$OC_{16}H_{33}$ | —$COOC_8H_{17}$ (5) | 0 | —$CH_3$ —$CH_3$ | —O— |
| Y-4 | $(CH_3)_3C$— | —Cl | —$COOC_{14}H_{29}$-n (5) | 0 | —$CH_3$ —$CH_3$ | —O— |
| Y-5 | $(CH_3)_3C$— | —Cl | —$COOC_{16}H_{33}$-n (5) | 0 | —$CH_3$ —$CH_3$ | —O— |
| Y-6 | $(CH_3)_3C$— | —Cl | —$COOCH_2CH(C_6H_{13}\text{-n})C_8H_{17}$-n (5) | 0 | —H —H | —O— |
| Y-7 | $(CH_3)_3C$— | —Cl | —$COOCH(CH_3)COOC_{12}H_{25}$-n (5) | 0 | —$CH_3$ —$CH_3$ | —O— |
| Y-8 | $(CH_3)_3C$— | —Cl | —$COOCH(C_4H_9)COOC_{12}H_{25}$-n (5) | 1 —$NHSO_2CH_3$ (4) | —$CH_3$ —$C_2H_5$ | —O— |
| Y-9 | $(CH_3)_3C$— | —$OCH_3$ | —$COOC_{12}H_{25}$-n (4) | 0 | —$CH_3$ —$CH_3$ | —O— |
| Y-10 | $(CH_3)_3C$— | —F | —$COOC_{14}H_{29}$-n (4) | 0 | —H —H | —S— |
| Y-11 | 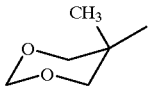 | —Cl | —$COOC_{14}H_{29}$-n (5) | 0 | —$CH_3$ —$CH_3$ | —$NCH_3$— |
| Y-12 | 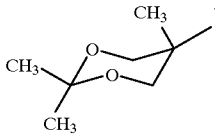 | —Cl | —$COOC_{12}H_{25}$-n (5) | 0 | —$CH_3$ —$CH_3$ | —O— |
| Y-13 | 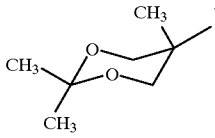 | —Cl | —$COOC_{12}H_{25}$-n (5) | 0 | —H —H | —S— |
| Y-14 | 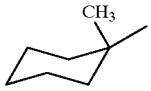 | —Cl | —$COOC_{12}H_{25}$-n (5) | 0 | —$CH_3$ —$CH_3$ | —O— |
| Y-15 | 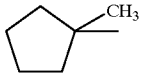 | —Cl | —$COOC_{12}H_{25}$-n (5) | 0 | —$CH_3$ —$CH_3$ | —NH— |
| Y-16 | 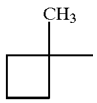 | —$OCH_3$ | —$COOC_{16}H_{33}$-n (5) | 0 | —$CH_3$ —$CH_3$ | —$NH_3$— |

-continued
| No. | —$R_1$ | —$R_2$ | —$R_3$ (*) | m —$R_4$ (**) | —$R_5$ —$R_6$ | —X— |
|---|---|---|---|---|---|---|
| Y-17 | 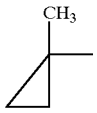 | —Cl | —$COOC_{14}H_{29}$-n (5) | 1 —Cl (4) | —$CH_3$ —$CH_3$ | —NH— |
| Y-18 | 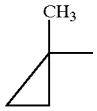 | —$OC_8H_{17}$ | —$COOC_{14}H_{29}$-n (5) | 1 —Cl (4) | —$CH_3$ —$CH_3$ | —$NCH_3$— |
| Y-19 | 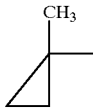 | —Cl | —$COOC_{16}H_{33}$-n (5) | 1 —Cl (4) | —$CH_3$ —$CH_3$ | —O— |
| Y-20 | 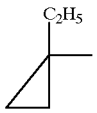 | —Cl | —$COOC_{14}H_{29}$-n (5) | 1 —Cl (4) | —$CH_3$ —$C_2H_5$ | —O— |
| Y-21 | 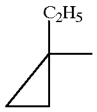 | —Cl | —$COOC_{14}H_{29}$-n (5) | 1 —Cl (4) | —$CH_3$ —$CH_3$ | —NH— |
| Y-22 | 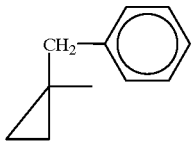 | —Cl | —$COOC_{12}H_{25}$-n (5) | 1 —Cl (4) | —$CH_3$ —$CH_3$ | —NH— |
| Y-23 | 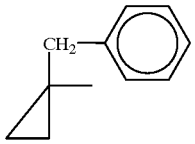 | —Cl | —$COOC_{10}H_{21}$-n (5) | 0 | —$CH_3$ —$C_2H_5$ | —O— |
| Y-24 | 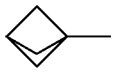 | —Cl | —$COOC_{16}H_{33}$-n (5) | 0 | —H —H | —N(—$C_6H_5$)— |
| Y-25 | 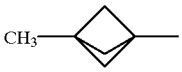 | —Cl | —$COOCH_2CH_2OC_{12}H_{25}$-n (5) | 0 | —$CH_3$ —$CH_3$ | —O— |
| Y-26 | 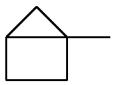 | —Br | —$COOCH_2CH(C_6H_{13}\text{-n})C_8H_{17}$-n (5) | 0 | —H —H | —S— |
| Y-27 | 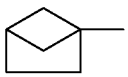 | —Cl | —$COOCH(CH_3)COOC_{12}H_{25}$-n (5) | 0 | —$CH_3$ —$CH_3$ | —O— |

-continued

| No. | —$R_1$ | —$R_2$ | —$R_3$ (*) | m —$R_4$ (**) | —$R_5$ —$R_6$ | —X— |
|---|---|---|---|---|---|---|
| Y-28 | 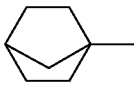 | —F | —$COOC_{12}H_{25}$-n (5) | 0 | —$CH_3$ —$CH_3$ | —O— |
| Y-29 | 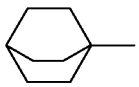 | —Cl | —$COOC_{14}H_{29}$-n (5) | 0 | —$CH_3$ —$C_2H_5$ | —O— |
| Y-30 | 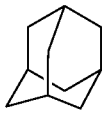 | —Cl | —$COOC_{12}H_{25}$-n (5) | 0 | —$CH_3$ —$C_2H_5$ | —O— |
| Y-31 | $(CH_3)_3C$— | —Cl | —$OSO_2C_{16}H_{33}$-n (5) | 0 | —$CH_3$ —$CH_3$ | —O— |
| Y-32 | $(CH_3)_3C$— | —Cl | —$OSO_2C_{16}H_{33}$-n (5) | 0 | —H —H | —S— |
| Y-33 | $(CH_3)_3C$— | —Cl | —$OSO_2C_{16}H_{33}$-n (5) | 0 | —$CH_3$ —$CH_3$ | —NH— |
| Y-34 | $(CH_3)_3C$— | —Cl | —$OSO_2C_{16}H_{33}$-n (5) | 0 | —$CH_3$ —$CH_3$ | —O— |
| Y-35 | 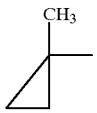 | —Cl | —$OSO_2C_{16}H_{33}$-n (5) | 0 | —$CH_3$ —$CH_3$ | —$NCH_3$— |
| Y-36 | 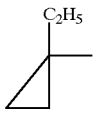 | —Cl | —$OSO_2C_{16}H_{33}$-n (5) | 0 | —$CH_3$ —$CH_3$ | —$NCH_3$— |

*Substitution position of $R_3$
**Substitution position of $R_4$

The yellow coupler of the present invention can be synthesized by the methods described in the respective specifications of JP-A-55-598, JP-A-56-87041, JP-A-4-218042, JP-A-4-344640, JP-A-5-53269 and JP-A-5-80469, Journal of Research Disclosure, No. 180, 53 (1979) and EP672,946A.

The yellow coupler of the present invention can be added to any layer of the light-sensitive material. In a multi-layer color light-sensitive material, the addition to a blue-sensitive silver halide emulsion layer, or to an adjacent non-light-sensitive layer such as protective layer, yellow filter layer or interlayer is particularly preferable, and the addition to a blue-sensitive silver halide emulsion layer is most preferable. The addition amount of the yellow coupler of the present invention is 0.01 to 10 mmol, preferably 0.1 to 5 mmol, and more preferably 0.2 to 2 mmol, per 1 $m^2$ of the light-sensitive material.

The yellow coupler of the present invention can be used in combination with other known yellow coupler, for example, a benzoylacetoanilide coupler, a malondianilide coupler, a dialkylcarbamoylacetoanilide coupler, and 1-indolinylcarbonylacetoanilide coupler. The addition of the yellow coupler of the present invention is performed, for example, by a method of preparing a coupler dispersion using an oil-in-water dispersion method described in U.S. Pat. No. 2,322,027 and adding the coupler dispersion to a coating solution. A weight ratio of a high-boiling organic solvent used in the oil-in-water dispersion method to the coupler is preferably small, preferably 2.0 or less, more preferably 1.0 or less, and particularly 0.5 or less. In case of the lower limit, the dispersion may be a dispersion using no high-boiling organic solvent. A latex dispersion method can also be applied. Small weight ratio of the high-boiling organic solvent to the coupler is preferable for reducing an amount of a developing agent remained in the oil droplets after color developing process. Because the remaining developing agent is oxidized by air during the preservation to cause a coupling reaction with the remained coupler at the non-color-developed portion, thereby forming a yellow dye. In the coupler of the present invention, high activation exerts strong influence thereon, particularly. It is also preferable because the film thickness can be reduced and the sharpness can be improved.

The yellow coupler of the present invention shows a coupling activity higher than that of a conventional acetoanilide two-equivalent coupler wherein an acyl group having a tertiary alkyl group is substituted. Therefore, the yellow coupler of the present invention provides a silver halide color photographic light-sensitive material having a high sensitivity and a hard gradation in photographic properties, and a good color properties. This high coupling activity is provided by introduction of a ballast for imparting specific nondiffusibility to an anilide nucleus of an acetoanilide mother nucleus wherein an acyl group having the specific tertiary alkyl group is substituted, and substitution of one of hydrogen atoms at the coupling activation portion with a specific releasing group.

Regarding the coupler of the present invention, not only the coupling activity can be increased as described above, but also the molecular weight of the coupler can be reduced by the introduction of a mother nucleus and a specific low-molecular weight releasing group in comparison with a benzoylacetoanilide type two-equivalent coupler as a main coupler of a color negative light-sensitive material. Consequently, a coating weight per unit area of the coupler coated on the light-sensitive material can be reduced and a reduction in thickness of the later can be realized.

The light-sensitive material of the present needs only to have at least one light-sensitive layer on a support. A typical example of the light-sensitive materials of the present invention is a silver halide photographic light-sensitive material having, on the support, at least one light-sensitive layer constituted by a plurality of silver halide emulsion layers which are sensitive to the same color but which have different sensitivities or speeds. The light-sensitive layer is a unit light-sensitive layer which is sensitive to any one of blue light, green light and red light and, in a multi-layered silver halide color photographic light-sensitive material, a generally adopted order of the unit light-sensitive layers from the support is red-sensitive layer, a green-sensitive layer and a blue-sensitive layer. However, according to the intended use, this order of layers may be reversed, or a layer having a different color sensitivity may be sandwiched between layers having the same color sensitivity in accordance with the application. Non-light-sensitive layers can be formed between the silver halide light-sensitive layers and as the uppermost layer and the lowermost layer. These non-light-sensitive layers can contain, e.g., couplers, DIR compounds, color mixture preventives described later. As a plurality of silver halide emulsion layers constituting a unit light-sensitive layer, a two-layered structure of high-speed and low-speed emulsion layers can be preferably arranged such that the sensitivity or speed is sequentially decreased toward a support as described in West German Patent 1,121,470 or British Patent 923,045. Alternatively, as described in JP-A-57-112751, JP-A-62-200350, JP-A-62-206541 and JP-A-62-206543, layers may be arranged such that a low-speed emulsion layer is formed remotely from a support and a high-speed layer is formed close to the support.

Specifically, layers may be arranged from the remotest side from a support in an order of low-speed blue-sensitive layer (BL)/high-speed blue-sensitive layer (BH)/high-speed green-sensitive layer (GH)/low-speed green-sensitive layer (GL)/high-sensitive red-sensitive layer (RH)/low-speed red-sensitive layer (RL), or BH/BL/GL/GH/RH/RL, or BH/BL/GH/GL/RL/RH.

Further, layers may be arranged from the remotest side from a support in an order of blue-sensitive layer/GH/RH/GH/RL as described in JP-B-55-34932. Alternatively, layers may be arranged of from the remotest side from a support in an order of blue-sensitive layer/GL/RL/GH/RH as described in JP-A-56-25738 and JP-A-62-63936.

Further, as described in JP-B-15495 ("JP-B" means Published Examined Japanese Patent Application), three layers may be arranged such that a silver halide emulsion layer having the highest sensitivity is arranged as an upper layer, a silver halide emulsion layer having sensitivity lower than that of the upper layer is arranged as an intermediate layer, and a silver halide emulsion layer having sensitivity lower than that of the intermediate layer is arranged as a lower layer, i.e., the three layers having different sensitivities may be arranged such that the sensitivity is sequentially decreased toward the support. Also, when the light-sensitive material comprises the three layers having different sensitivities or speed, these layers may be arranged from far to near the support in the order of medium-speed emulsion layer/high-speed emulsion layer/low-speed emulsion layer within a layer sensitive to one and the same color sensitivity as described in JP-A-59-202464.

In addition, an order of high-speed emulsion layer/low-speed emulsion layer/medium-speed emulsion layer, or an order of low-speed emulsion layer/medium-speed emulsion layer/high-speed emulsion layer may be adopted.

Furthermore, the arrangement can be changed as described above, even when four or more layers are formed.

In order to improve color reproductivity, a donor layer (CL) having different spectral sensitivity distribution from that of a main light-sensitive layer such as BL, GL and RL and having interlayer effect, described in the specification of U.S. Pat. No. 4,663,271, U.S. Pat. No. 4,705,744, U.S. Pat. No. 4,707,436, JP-A-62-160448 and JP-A-63-89850, is preferably arranged adjacent to or in the vicinity of the main light-sensitive layer.

A preferable silver halide to be used in photographic emulsion layers of the photographic light-sensitive material of the present invention is silver iodobromide, silver iodochloride or silver iodochlorobromide containing about 30 mol % or less of silver iodide. A particularly preferable silver halide is silver iodobromide or silver iodochlorobromide each containing about 2 mol % to about 10 mol % of silver iodide.

The silver halide grains contained in the photographic emulsion may be in the form of regular crystals, such as cubes, octahedrons and decatetrahedrons, irregular crystals, such as spheres and tabulars, crystals having defects such as twin planes, or composite shapes thereof.

The grain sizes of the silver halide may range from fine grains having a grain diameter of about 0.2 $\mu$m or less or to large grains having a diameter of the projected area of a grain of up to about 10 $\mu$m. Further, the silver halide emulsion may be a polydisperse emulsion or a monodisperse emulsion.

The silver halide photographic emulsion usable in the present invention can be prepared by the methods described, for example, in Research Disclosure (hereinafter abbreviated to RD) No. 17643 (December 1978), pages 22–23, "I. Emulsion Preparation and Types"; RD No. 18716 (November 1979), page 648, and RD No. 307105 (November 1989), pages 863–865; P. Glafkides, "Chimie et Physique Photographiques", Paul Montel, 1967; G. F. Duffin, "Photographic Emulsion Chemistry", Focal Press 1966; and V. L. Zelikman et al., "Making and Coating Photographic Emulsion", Focal Press, 1964.

Also preferable is the monodisperse emulsion described in U.S. Pat. No. 3,574,628, U.S. Pat. No. 3,655,394 and British Patent 1,413,748.

Further, tabular grains having an aspect ratio of about 3 or more can also be used in the present invention. The tabular grains can be easily prepared by the methods described in Gutoff, "Photographic Science and Engineering", Vol. 14, pp. 248–257 (1970); U.S. Pat. No. 4,434,226; 4,414,310; 4,433,048 and 4,439,520, and British Patent 2,112,157.

The crystal structure may be uniform, may have different halogen compositions in its interior and exterior, or may be layered structure. Alternatively, silver halide having different compositions may be joined by an epitaxial junction, or a compound other than a silver halide such as silver rhodanide or lead oxide may be joined. A mixture composed of grains having various crystal forms may also be used.

The above-mentioned emulsion needs to be a negative-type emulsion, although it may be of a surface latent image type which forms a latent image mainly on the surface of the grains, an inner latent image type which forms a latent image inside the grains, or other type which forms a latent image both inside and outside the grain. The emulsion belonging to the inner latent image type may be of the inner latent image type having a core/shell structure described in JP-A-63-264740, the method for making which emulsion is described in JP-A-59-133542. The thickness of the shell for this emulsion is preferably 3 to 40 nm and most preferably 5 to 20 nm, although the thickness varies depending on processing conditions for development and the like.

Prior to the use of the light-sensitive material of present invention, the silver halide usually undergoes a chemical ripening, a physical ripening, and a spectral sensitization steps. The additives which are used at such steps are described in RD No. 17643, RD No. 18716 and RD No. 307105 and are summarized later in a table with the indications of the relevant places of description.

In the light-sensitive material of the present invention, a mixture of two or more emulsions, which differ from one another in at least one of the characteristics selected from the group consisting of grain size, grain size distribution, halogen composition, shape of grain and sensitivity, can be used in the same layer.

It is preferable to use silver halide grains having surface-fogged grain described in U.S. Pat. No. 4,082,553, silver halide grains having internally fogged grain described in U.S. Pat. No. 4,626,498 and JP-A-59-214852, or colloidal silver in a light-sensitive silver halide emulsion layer and/or in a substantially non-light-sensitive hydrophilic colloidal layer. The silver halide grains having internally fogged grain or surface-fogged silver halide grains capable of being developed uniformly (non-imagewise) irrespective of the unexpected and exposed area portions of the light-sensitive material. The method for making the internally fogged or surface-fogged silver halide grains is described in U.S. Pat. No. 4,626,498 and JP-A-59-214852. The silver halide, which constitutes the inner core of core/shell-type silver halide grains having the internally fogged grain, may have a different halogen composition. The silver halide grains having internally fogged grain or surface-fogged grain may be any silver halide selected from the group consisting of silver chloride, silver chlorobromide, silver iodobromide and silver chloroiodobromide. The average grain sizes of these fogged silver halide grains are in the range of 0.01 to 0.75 $\mu$m, and more preferably in the range of 0.05 to 0.6 $\mu$m. Although the emulsion may be made up of grains having regular shapes or may be a polydisperse emulsion, it is preferably a monodisperse emulsion (in which at least 95 wt % or number of silver halide grains have grain diameters falling within the range of ±40% or less of the average diameter).

It is preferable to use non-light-sensitive silver halide fine grains in the present invention. The non-light-sensitive silver halide fine grains mean the silver halide fine grains which are not sensitized in the imagewise exposure for forming a dye image and are substantially undeveloped when processed for development. Preferably, the non-light-sensitive silver halide fine grains are not fogged in advance. The fine-grain silver halide has a silver bromide content of 0 to 100 mol %. If necessary, the fine-grain silver halide may further contain silver chloride and/or silver iodide. Preferred silver iodide content is 0.5 to 10 mol %. The average grain diameter (average value of the equivalent-circle diameter of projected area) of the fine-grain silver halide is preferably 0.01 to 0.5 $\mu$m, and more preferably 0.02 to 0.2 $\mu$m.

The fine-grain silver halide can be prepared by the same method as that for a conventional light-sensitive silver halide. No optical sensitization or spectral sensitization is necessary for the surface of the grains of the silver halide. However, it is preferable to add to the silver halide grains a known stabilizer such as a triazole compound, an azaindene compound, a benzothiazole compound, a mercapto compound or a zinc compound, before the silver halide is added to a coating solution. A layer, which contains the fine-grain silver halide, may further contain colloidal silver.

The coating amount of silver of the light-sensitive material of the present invention is preferably 6.0 g/m$^2$ or less, and most preferably 4.5 g/m$^2$ or less.

The photographic additives usable in the present invention are also described in RD and the following table shows the additives together with the relevant places of description.

| | Additives | RD17643 | RD18716 | RD307105 |
|---|---|---|---|---|
| 1. | Chemical sensitizer | p 23 | p 648, r.c. | p 866 |
| 2. | Sensitivity increasing agent | | p 648, r.c. | |
| 3. | Spectral sensitizer Super sensitizer | p 23–24 | p 648, r.c.–p 649, r.c. | p 866–868 |
| 4. | Brightener | p 24 | p 647, r.c. | p 868 |
| 5. | Light absorber Filter dye, Ultraviolet absorbent | p 25–26 | p 649, r.c.–p 650, l.c. | p 873 |
| 6. | Binder | p 26 | p 651, l.c. | p 873–874 |
| 7. | Plasticizer, Lubricant | p 27 | p 650, r.c. | p 876 |
| 8. | Coating aid, Surfactant | p 26–27 | p 650, r.c. | p 875–876 |
| 9. | Antistatic agent | p 27 | p 650, r.c. | p 876–877 |
| 10. | Matting agent | | | p 878–879 |

(Note)
p: page
r.c.: right column
l.c.: left column

Various dye formation couplers can be used in the light-sensitive material of the present invention, and the following couplers are particularly preferable.

Yellow couplers: couplers represented by Formulas (I) and (II) in European Patent (hereinafter referred to as EP) 502,424A; couplers (particularly Y-28 on page 18) represented by Formulas (1) and (2) in EP 513,496A; a coupler represented by Formula (I) in claim 1 of EP 568,037A; a coupler represented by Formula (I) in claim 1, lines 45 to 55, in U.S. Pat. No. 5,066,576; a coupler represented by Formula (I) in paragraph 0008 of JP-A-4-274425; couplers (particularly D-35 on page 18) described in claim 1 on page 40 in EP 498,381A1; couplers (particularly Y-1 (page 17) and Y-54 (page 41)) represented by Formula (Y) on page 4 in EP 447,969A1; and couplers (particularly II-17 and II-19 (column 17) and II-24 (column 19)) represented by Formulas (II) to (IV) in column 7, lines 36–58, in U.S. Pat. No. 4,476,219.

Magenta couplers: JP-A-3-39737 (L-57 (page 11, lower right column), L-68 (page 12, lower right column), and L-77 (page 13, lower right column); (A-4)-63 (page 134), and (A-4)-73 and (A-4)-75 (page 139) in EP 456,257; M-4 and M-6 (page 26), and M-7 (page 27) in EP 486,965; M-45 (page 19) in EP 571,959A; (M-1) (page 6) in JP-A 5-204196; and M-22 in paragraph 0237 of JP-A-4-362631.

Cyan couplers: CX-1, CX-3, CX-4, CX-5, CX-11, CX-12, CX-14, and CX-15 (pages 14 to 16) in JP-A-4-204843; C-7 and C-10 (page 35), C-34 and C-35 (page 37), and (I-1) and (I-17) (pages 42 and 43) in JP-A-4-43345; and couplers represented by Formula (*Ia*) and (*Ib*) described in claim 1 of JP-A-6-67385.

Polymer couplers: P-1 and P-5 (page 11) in JP-A-2-44345.

Couplers for forming a colored dye having a proper diffusibility are preferably those described in U.S. Pat. No. 4,366,237, British Patent 2,125,570, EP 96,873B and West German Laid-open Patent Application 3,234,533.

Preferable couplers for correcting unnecessary absorption of a colored dye are yellow colored cyan couplers (particularly YC-86 on page 84) represented by Formulas (CI), (CII), (CIII) and (CIV) described on page 5 in EP 456,257A1; yellow colored magenta couplers ExM-7 (page 202), Ex-1 (page 249) and Ex-7 (page 251) in EP 456,257A; magenta colored cyan couplers CC-9 (column 8) and CC-13 (column 10) described in U.S. Pat. No. 4,833,009; (2) (column 8) in U.S. Pat. No. 4,838,136; and colorless masking couplers (particularly compound examples on pages 36 to 45) represented by Formula (A) described in claim 1 of WO 92/11,575.

Example of a compound (including a coupler) which reacts with a developing agent oxidized form and releases a photographically useful compound residue are as follows. Development inhibitor release compounds: compounds (particularly T-101 (page 30), T-104 (page 31), T-113 (page 36), T-131 (page 45), T-144 (page 51) and T-158 (page 58)) represented by Formulas (I), (II), (III) and (IV) described on page 11 in EP 378,236A; compounds (particularly D-49 (page 51)) represented by Formula (I) described on page 7 in EP 436,938A2; compounds (particularly (23) (page 11)) represented by Formula (I) in EP 568,037A; compound (particularly I-(1) on page 29) represented by Formulas (I), (II) and (III) described on pages 5 and 6 in EP 440,195A2; bleaching accelerator release compounds: compound (particularly (60) and (61) on page 61) represented by Formulas (I) and (I') described on page 5 in EP 310,125A2; and compounds (particularly (7) (page 7)) represented by Formula (I) described in claim 1 of JP-A-6-59411; ligand release compounds: compound (particularly compounds in column 12, lines 21 to 41) represented by LIG-X described in claim 1 of U.S. Pat. No. 4,555,478; leuco dye release compounds; compounds 1 to 6 in columns 3 to 8 of U.S. Pat. No. 4,749,641; fluorescent dye release compounds; compounds (particularly compounds 1 to 11 in columns 7 to 10) represented by COUP-DYE described in claim 1 of U.S. Pat. No. 4,774,181; development accelerators of fogging agent release compounds; compounds (particularly compound (I-22) in column 25) represented by Formulas (1), (2) and (3) described in column 3 of U.S. Pat. No. 4,656,123, and compounds represented by ExZK-2 described on page 75, lines 36 to 38, in EP 450,637A2; and compounds which release a group which dose not function as a dye unless it splits off;

compounds (particularly Y-1 to Y-19 in columns 25 to 36) represented by Formula (I) in claim 1 of U.S. Pat. No. 4,857,447.

Preferable examples of additive other than couplers are as follows:

Dispersants of an oil-soluble organic compound: P-3, P-5, P-16, P-19, P-25, P-30, P-42, P-49, P-54, P-55, P-66, P-81, P-85 and P-93 (pages 140 to 144) in JP-A-62-215272; impregnating latexes of an oil-soluble organic compound: latexes described in U.S. Pat. No. 4,199,363; developing agent oxidized form scavengers: compounds (particularly I-(1), I-(2), I-(6) and I-(12) (columns 4 and 5)) represented by Formula (I) in column 2, lines 54 to 62, in U.S. Pat. No. 4,978,606, and formulas (particularly compound 1 (column 3)) in column 2, lines 5 to 10, in U.S. Pat. No. 4,923,787; stain inhibitors; Formulas (I) to (III) on page 4, lines 30 to 33, particularly I-47, I-72, III-1 and III-27 (pages 24 to 48) in EP 298,321A; brown inhibitors: A-6, A-7, A-20, A-21, A-23, A-24, A-25, A-26, A-30, A-37, A-40, A-42, A-48, A-63, A-90, A-92, A-94 and A-164 (pages 69 to 118) in EP 298,321A, II-1 to III-23, particularly III-10, in columns 25 to 38 of U.S. Pat. No. 5,122,444, I-1 to III-4, particularly II-2, on pages 8 to 12 in EP 471,347A, and A-1 to A-48, particularly A-39 and A-42, in columns 32 to 40 of U.S. Pat. No. 5,139,931; materials which reduce the use amount of a color enhancer or a color amalgamation inhibitor: I-1 to II-15, particularly I-46, on pages 5 to 24 in EP 411,324A; formalin scavengers: SCV-1 to SCV-8, particularly SCV-8, on pages 24 to 29 in EP 477,932A; film hardeners: H-1, H-4, H-6, H-8 and H-14 on page 17 in JP-A-1-214845, compounds (H-1 to H-54) represented by Formulas (VII) to (XII) in columns 13 to 23 of U.S. Pat. No. 4,618,573, compounds (H-1 to H-76), particularly H-14, represented by Formula (6) on page 8, lower right column, in JP-A-2-214852, and compounds described in claim 1 of U.S. Pat. No. 3,325,287; development inhibitor precursors: P-24, P-37 and P-39 (pages 6 and 7) in J-A-62-168139 and compounds described in claim 1, particularly 28 and 29, in column 7, of U.S. Pat. No. 5,019,492; antiseptic agents and mildewproofing agents: I-1 to III-43, particularly II-1, II-9, II-10, II-18 and III-25, in columns 3 to 15 of U.S. Pat. No. 4,923,790; stabilizers and aitifoggants: I-1 to (14), particularly I-1, 60, (2) and (13), in columns 6 to 16 of U.S. Pat. No. 4,923,793, and compounds 1 to 65, particularly compound 36, in columns 25 to 32 of U.S. Pat. No. 4,952,483; triphenylphosphine selenide: compound 50 described in JP-A-5-40324; dyes: a-1 to b-20, particularly a-1, a-12, a-18, a-27, a-35 and 3-26 and b-5 on pages 15 to 18, and V-1 to V-23, particularly V-1, on pages 27 to 29 in JP-A-3-156450, F-I-1 to F-II-43, particularly F-I-11 and F-11-8, on pages 33 to 55 in EP 445,727A, III-1 to III-36, particularly III-1 and III-3, on pages 17 to 28 in EP 457,153A, fine crystal dispersions of Dye-1 to Dye-124 on pages 8 to 26 in WO 88/04,794, compounds 1 to 22, particularly compound 1, on pages 6 to 11 in EP 319,999A, compounds D-1 to D-87 (pages 3 to 28) represented by Formulas (1) to (3) in EP 519,306A, compounds 1 to 22 (columns 3 to 10) represented by Formulas (I) in U.S. Pat. No. 4,268,622, and compounds (1) to (31) (columns 2 to 9) represented by Formulas (I) in U.S. Pat. No. 4,923,788; and UV absorbents: compounds (18b) to (18r) and 101 to 427 (pages 6 to 9) represented by Formulas (1) in JP-A-46-3335, compounds (3) to (66) (pages 10 to 44) represented by Formula (I) and compounds HBT-1 to HBT-10 (page 14) represented by Formula (III) in EP 520,938A, and compounds (1) to (31) (columns 2 to 9) represented by Formula (1) in EP 521,823A.

The present invention can be applied to various color light-sensitive materials such as a color negative film for a general purpose or a movie and a color reversal film, a color paper, a color positive film and a color reversal paper for a slide or a television. The present invention is also suited to film units with lens described in JU-B-2-32615 and JU-B-3-38784 ("JU-B" means Published Examined Japanese Utility Model Application).

A support which can be suitably used in the present invention is described in, e.g., RD No. 17643, page 28, RD No. 18716, from right column, page 647, to left column, page 648, and RD No. 307105, page 879.

In the light-sensitive material of the present invention, the sum total of film thickness of all hydrophilic colloid layers on the side having the emulsion layers is preferably 28 μm or less, more preferably 23 μm or less, particularly preferably 18 μm or less, and most preferably 16 μm or less. A film swell speed $T_{1/2}$ is preferably 30 seconds or less, and more preferably 20 seconds or less. $T_{1/2}$ is defined as a time which the film thickness requires to reach ½ of a saturation film thickness which is 90% of a maximum swell film thickness reached when processing is performed by using a color developer at 30° C. for 3 min and 15 seconds. The film thickness means the thickness of a film measured under moisture conditioning at a temperature of 25° C. and a 55% relative humidity (two days). $T_{1/2}$ can be measured by using a swell meter described in Photographic Science Engineering, A. Green et al., Vol. 19, No. 2, pp. 124–129. $T_{1/2}$ can be adjusted by adding film hardening agent to gelatin as a binder or changing aging conditions after coating. The swell ratio is preferably 150 to 400%. The swell ratio can be calculated from the maximum swell film thickness under the conditionings mentioned above by using (maximum swell film thickness-film thickness)/film thickness.

In the light-sensitive material of the present invention, hydrophilic colloid layers (called back layers) having a total dried film thickness of 2 to 20 μm are preferably formed on the side opposite to the side having emulsion layers. The back layers preferably contain, e.g., the light absorbent, the filter dye, the ultraviolet absorbent, the antistatic agent, the film hardener, the binder, the plasticizer, the lubricant, the coating aid, and the surfactant, described above. The swell ratio of the back layer is preferably 150 to 500%.

The light-sensitive material of the present invention can be processed for development by a conventional method described in aforesaid RD No. 17643, pages 28 and 29, RD No. 18716, page 651, from left column to right column, and RD No. 307105, pages 880 and 881.

The processing solution for a color negative film of the present invention is described below.

The color developing solution of the present invention may contain the compounds described in JP-A-4-121739, page 9, upper right column, line 1 to page 11, lower left column, line 4. Preferred developing agents for the rapid processing are 2-methyl-4-(N-ethyl-N-(2-hydroxyethyl) amino)aniline, 2-methyl-4-(N-ethyl-N-(3-hydroxypropyl) amino)aniline and 2-methyl-4-(N-ethyl-N-(4-hydroxybutyl) amino)aniline.

The concentration of these color developing agents is preferably 0.01 to 0.08 mol, more preferably 0.015 to 0.06 mol, and most preferably 0.02 to 0.05 mol per liter of the color developing solution. The concentration of these color developing agents in a replenisher solution of the color developing solution is preferably 1.1 to 3 times, more preferably 1.3 to 2.5 times, the concentration in the color developing solution.

The color developing solution of the present invention may contain a hydroxylamine as a general purpose preservative. If a higher-level preservation is required, preferable preservatives are hydroxylamine derivatives having substituents such as alkyl, hydroxyalkyl, sufoalkyl and carboxyl groups, preferred examples of which are N,N-di(sulfoethyl) hydroxylamine, monomethylhydroxylamine, dimethylhydroxylamine, monoethylhyroxylamine, diethylhydroxylamine and N,N-di(carboxylethyl)hydroxylamine. Among the above-mentioned derivatives, N,N-di (sulfoethyl)hydroxylamine is particularly preferable. Although any of these derivatives may be used in combination with hydroxylamine, preferably one, or two or more of these derivatives are used instead of hydroxylamine.

The concentration of the preservative is preferably 0.02 to 0.2 mol, more preferably 0.03 to 0.15 mol, and most preferably 0.04 to 0.1 mol per liter of the color developing solution. The concentration of the preservative in a replenisher solution of the color developing solution is 1.1 to 3 times the concentration in the mother solution (i.e., the solution in the processing tank).

In order to prevent the tarring of the developing agent oxidized form, the color developing solution contains a sulfite. The concentration of the sulfite is preferably 0.01 to 0.05 mol and particularly preferably 0.02 to 0.04 mol per liter of the color developing solution. The concentration of the sulfite in a replenisher solution of the color developing solution is 1.1 to 3 times the concentration mentioned above.

The pH value of the color developing solution is preferably 9.8 to 11.0 and particularly preferably 10.0 to 10.5. The pH value of a replenisher solution of the color developing solution is set to a value preferably 0.1 to 1.0 above the above-mentioned values. In order to maintain pH at the above-mentioned values in a stable manner, a known buffer solution such as a carbonate, a phosphate, a sulfosalicylate or a borate is used.

The quantity of replenisher of the color developing solution is preferably 80 to 1,300 mL per $m^2$ of the light-sensitive material. From the viewpoint of reducing the polluting load to environment, the quantity should be reduced and is preferably 80 to 600 mL, more preferably 80 to 400 mL.

The bromide ion concentration in the color developing solution is usually 0.01 to 0.06 mol per liter of the color developing solution. Preferably, the bromide ion concentration is set to 0.015 to 0.03 mol per liter of the color developing solution for the purpose of fog inhibition and enhancement of discrimination while maintaining the sensitivity and for overcoming the problem of graininess. If the bromide ion concentration is set to the above-mentioned range, the replenisher solution needs to contain the bromide ions at the concentration given by the following equation; provided that the replenisher solution preferably contains no bromide ion if the calculated value C is negative.

$$C=A-W/V$$

where

C: Bromide ion concentration (mol/L) of the replenisher solution of the color developing solution;

A: target bromide ion concentration (mol/L) in the color developing solution;

W: Amount (mol) of the bromide ions which dissolve into the color developing solution from the light-sensitive material when 1 $m^2$ of the light-sensitive material was processed for development; and V: Quantity of replenisher of the color developing solution per $m^2$ of the light-sensitive material If the quantity of replenisher is reduced or the bromide ion concentration is set to a large value, it is preferable to use development accelerators, such as pyrazolidones represented by 1-phenyl-3-pyrazolidone or 1-phenyl-2-methyl-2-hydroxymethyl-3-pyrazolidone, and thioether compounds represented by 3,6-dithia-1,8-octanediol, as a means for increasing the sensitivity.

The compounds or processing conditions, which are described in JP-A-4-125558, page 4, lower left column, line 15 to page 7, lower left column, line 6, can be applied to the processing solution having a bleaching power of the present invention.

A preferable bleaching agent has a redox potential of 150 mV or more. Preferred examples of the bleaching agents are described in JP-A-5-72694 and JP-A-5-173312. Particularly preferred examples are 1,3-diaminopropanetetraacetic acid and ferric complex salts of the compounds shown as example 1 in JP-A-5-173312.

It is preferable to use the ferric complex salts of the compounds described in JP-A-4-251845, JP-A-268552, EP 588,289, EP 591,934 and JP-A-6-208213 as a bleaching agent to increase the biodegradability of the bleaching agent. The concentration of the bleaching agent is preferably 0.05 to 0.3 mol per liter of the solution having a bleaching power. Preferably, the concentration is set to 0.1 to 0.15 mol in order to reduce the discharge amount to environments. If the solution having a bleaching power is a bleaching solution, it is desirable that the solution contain the bromide ions at a concentration of 0.2 to 1 mol, preferably 0.3 to 0.8 mol, per liter of the solution.

The replenisher solution of the solution having a bleaching power needs to have concentration of the components shown below which are basically calculated by the following equation. As a result, the concentration in the mother solution can be maintained at a constant value.

$$C_R=C_T\times(V_1+V_2)/V_1+C_p$$

where $C_R$: Concentration of the component in the replenisher solution;

$C_T$: Concentration of the compound in the mother solution (solution in the processing tank)

$C_p$: Concentration of the component consumed during the processing;

$V_1$: Quantity (mL) of replenisher solution having a bleaching power per $m^2$ of the light-sensitive material; and $V_2$: Quantity (mL) carried over from the preceding bath per $m^2$ of the light-sensitive material.

Further, it is preferable that the bleaching solution contain a pH buffering agent, preferred examples of which are low-odor dicarboxylic acids such as succinic acid, maleic acid, malonic acid, glutaric acid and adipic acid. It is also preferable to use known bleaching accelerators described in JP-A-53-95630, RD No. 17129 and U.S. Pat. No. 3,893,858.

It is desirable that the bleaching solution be supplied with 50 to 1,000 mL, preferably 80 to 500 mL, and most preferably 100 to 300 mL of a replenisher solution of the bleaching solution per $m^2$ of the light-sensitive material. Further, it is preferable that the bleaching solution be aerated.

The compounds or processing conditions, which are described in JP-A-4-125558, page 7, lower left column, line 10 to page 8, lower right column, line 19, can be applied to the processing solution having a fixing power of the present invention.

In particular, in order to increase the fixing speed and the preservability of the solution, the solution having a fixing power preferably contains the compounds represented by the Formulas (I) and (II) in JP-A-6-301169 singly or as a combination. In addition, from the viewpoint of the enhancement of the preservability, it is preferable to use a sulfinic acid, such as p-toluenesulfinic acid salt, described in JP-A-1-224762.

When viewed from the enhancement of the desilvering capability, it is desirable that the solution having a bleaching power or a fixing power contain ammonium as a cation. However, it is preferable to decrease the ammonium content of the solution or to make the solution ammonium-free from the viewpoint of the reduction of the environmental pollution.

It is particularly preferable to carry out the jet-agitation of the solution described in JP-A-1-309059 at the steps of bleaching, bleach-fixing and fixing.

The quantity of replenisher at a bleach-fixing step or fixing step is 100 to 1,000 mL, preferably 150 to 700 mL, and most preferably 200 to 600 mL per $m^2$ of the light-sensitive material.

Preferably, the bleach-fixing step or fixing step is provided with an in-line or off-line silver recovery unit so that the silver is recovered. If an in-line unit is used, the quantity of replenisher can be reduced, because the silver concentration in the solution in the bath becomes smaller owing to the treatment. Meanwhile, it is also desirable to remove the silver by means of an off-line unit so that the residual solution is re-used as a replenisher solution.

The bleach-fixing step or fixing step may comprises a plurality of processing tanks, which are preferably arranged by a multistage counter-current method employing cascade piping. Because of the balance with the size of the processor, in general a two-tank cascade structure is efficient wherein the ratio of the processing time between the fore tank and the rear tank is preferably in the range of 0.5:1 to 1:0.5 and particularly preferably in the range of 0.8:1 to 1:0.8

From the viewpoint of increasing the preservability, the bleach-fixing solution or fixing solution preferably contains a free chelating agent which is not in the form of a complex with a metal. These chelating agents are preferably biodegradable chelating agents previously described in connection with the bleaching solution.

The techniques described in JP-A-4-125558, page 12, lower right column, line 6 to page 13, lower right column, line 16 can be preferably applied to the water-washing and stabilizing step. Particularly, in order to preserve the acceptable working environments, it is preferable to incorporate the stabilizing solution with an azolylmethylamine described in EP 504,609 and EP 519,190 or an N-methylolazole described in JP-A-4-362943 as formaldehyde substitute compounds and to make the magenta coupler bi-equivalent for the purpose of utilizing a solution of a surface active agent free of a formaldehyde-based image stabilizer.

Meanwhile, in order to reduce the amount of dusts adhering to the magnetic recording layer coated on the light-sensitive material, the stabilizing solution described in JP-A-6-289559 may be preferably used.

The quantity if replenisher of washing water or of the stabilizing solution is 80 to 1,000 mL, preferably 100 to 500 mL, and most preferably 150 to 300 mL per $m^2$ of the light-sensitive material both from securing the water-washing or stabilizing function and from the reduction of waste solution in view of the environmental preservation. In the processing which is performed with the above-mentioned quantity of replenisher, it is preferable to use a known mildewproofing agent, such as thiabendazole, 1,2-benzoisothiazoline-3-one or 5-chloro-2-methylisothiazoline-3-one, an antibiotic, such as gentamycin, and deionized water which has been deionization-treated with an ion-exchange resin in order to prevent the growth of bacteria or mildew. The use of a combination of deionized water with an anti-bacteria agent or an antibiotic is more effective.

Furthermore, it is desirable to reduce the amount of replenisher by the implementation of the reverse osmosis of the liquid inside the water-washing or stabilizing solution tank as described in JP-A-3-46652, JP-A-3-53246, JP-A-3-55542, JP-A-3-121448 and JP-A-3-126030. In this case, the reverse osmosis membrane is preferably a low-pressure reverse osmosis membrane.

In the processing of the present invention, it is particularly preferable to compensate for the evaporation of the processing solutions in accordance with the method described in Journal of Technical Disclosure No. 94-4992 of The Japan Institution of Innovation and Invention (hereinafter abbreviated as JIII). In particular, it is desirable to compensate for the evaporation based on the Equation (1) on page 2 by use of the temperature and humidity information in the environment where the process is placed. The water to be used to compensate for evaporation is preferably taken from a replenishment tank to the water-washing bath, and the replenishing water is preferably deionized water.

The processing agents described in the above-mentioned Journal of Technical Disclosure, page 3, right column, line 15 to page 4, left column, line 32 are desirable for use in the present invention. A desirable processor using these processing agents is the film processor described in the above-mentioned Journal of Technical Disclosure, page 3, right column, lines 22 to 28.

Concrete examples of the desirable processing agents, automatic processors and methods for compensating for evaporation are described in the above-mentioned Journal of Technical Disclosure, page 5, right column, line 11 to page 7, right column, final line.

The supply form of a processing agent to be used in the present invention can be any of a liquid having the concentration of a solution in use, a concentrated liquid, a granule, a powder, a pellet, a paste and an emulsion. Examples of these processing agents are a liquid contained in a low-oxygen-permeability vessel disclosed in JP-A-63-17453, vacuum-packaged powders or granules disclosed in JP-A-4-19655 and JP-A-4-230748, granules containing a water-soluble polymer disclosed in JP-A-4-221951, pellets disclosed in JP-A-51-61837 and JP-A-6-102628, and a processing agent in the form of a paste disclosed in PCT National Publication No. 57-500485. Any of these forms can be preferably used. However, in respect of simplicity in use, the use of a liquid already prepared to have a concentration in use is preferable.

The material of vessels containing these processing agents can be any of polyethylene, polypropylene, polyvinylchloride, polyethylene terephthalate and nylon. These materials can be used singly or in the form of a composite material. These materials are so selected as to meet the level of a necessary oxygen permeability. Low-oxygen-permeability materials are suited to a solution such as a color developing solution which is readily oxidized. Practical examples are polyethylene terephthalate and a composite material of polyethylene and nylon. The thickness of a vessel made from any of these materials is 500 to 1,500 $\mu$m. The oxygen permeability is preferably 20 $mL/m^2 \cdot 24$ hrs·atm or less.

The processing solution for the color reversal film to be used in the present invention is described below. The detail of the processing technique for a color reversal film is described in Journal of Known Technologies No. 6 (Apr. 1, 1991, issued from ASTECH Co., Ltd.), page 1, line 5 to page 10, line 5 and page 15, line 8 to page 24, line 2. Any of these techniques can be preferably used in the present invention.

In the processing of the color reversal film, the control bath or the final bath contains the image stabilizing agent. Among examples of these image stabilizing agents which are formalin, sodium formaldehydebisulfite and N-methylolazole, preferable is sodium formaldehydebisulfite or an N-methylolazole, N-methyloltriazole in particular, from the viewpoint of working environments. Further, the techniques, which were stated previously concerning the color developing solution, bleaching solution, fixing solution and washing water for the processing of color negative film, can also be preferably used for the processing of the color reversal film.

On the basis of the above description, preferred processing agents for color reversal films include E-6 Processing Agent manufactured by Eastman Kodak Co., Ltd. and CR-56 Processing Agent manufactured by Fuji Film Co., Ltd.

Then, a magnetic recording layer used in the present invention is described below.

The magnetic recording layer used in the present invention is formed by coating the surface of a support with an aqueous or organic solvent-based coating solution which is prepared by dispersing magnetic grains in a binder.

The magnetic grains used in the present invention can be ferromagnetic iron oxide such as $\gamma$ $Fe_2O_3$, Co-deposited $\gamma$ $Fe_2O_3$, Co-deposited magnetite, Co-containing magnetite, ferromagnetic chromium dioxide, a ferromagnetic metal, a ferromagnetic alloy, Ba ferrite of a hexagonal system, Sr ferrite, Pb ferrite and Ca ferrite. Co-deposited ferromagnetic iron oxide such as Co-deposited $\gamma$ $Fe_2O_3$ is preferable. The grain can take the shape of any of, e.g., a needle, a rice grain, a sphere, a cube and plate. A specific surface area is preferably 20 $m^2/g$ or more, and more preferably 20 $m^2/g$ or more as $S_{BET}$.

The saturation magnetization ($\sigma$ s) of the ferromagnetic substance is preferably $3.0\times10^4$ to $3.0\times10^5$ A/m, and most preferably $4.0\times10^4$ to $2.5\times10^5$ A/m. A surface treatment can be performed for the ferromagnetic grains by use of silica and/or alumina or an organic material. Also, the surface of the ferromagnetic grains can be treated with a silane coupling agent or a titanium coupling agent as described in JP-A-6-161032. Ferromagnetic grains, whose surface is coated with an inorganic or organic substance, described in JP-A-4-259911 and JP-A-5-81652 can also be used.

As the binder together with the magnetic grains, it is possible to use a thermoplastic resin, a thermosetting resin, a radiation-curable resin, a reactive resin, an acid-, alkali- or bio-degradable polymer, a natural polymer (e.g., a cellulose derivative and a saccharide derivative) and their mixtures described in JP-A-219569. Tg of the resin is −40° C. to 300° C., and its weight average molecular weight is 2,000 to 1,000,000. Examples of the resin are vinyl copolymer, cellulose derivatives, such as cellulose diacetate, cellulose triacetate, cellulose acetatepropionate, cellulose acetatebutylate and cellulose tripropionate, an acrylic resin, and a polyvinylacetal resin. Gelatin is also preferable. Cellulose di(tri)acetate is particularly preferable. The binder can be hardened by the addition of an epoxy, aziridine, or isocyanate crosslinking agent. Examples of the isocyanate crosslinking agent include isocyanates, such as tolylenediisocyanate, 4,4'-diphenylmethanediisocyanate, hexamethylenediisocyanate and xylylenediisocyanate, reaction products of these isocyanates and polyalcohols (e.g., a reaction product of 3 mols of tolylenediisocyanate and 1 mol of trimethylolpropane), and a polyisocyanate produced by condensation of any of these isocyanates. These examples are described in, e.g., JP-A-6-59357.

As a method for dispersing the magnetic substance in the binder, as described in JP-A-6-35092, the use of a kneader, a pin-type mill or an annular mill is preferable, and a combination of them is also preferable. Dispersants described in JP-A-5-088283 and other known dispersants can be used. The thickness of the magnetic recording layer is 0.1 to 10 $\mu$m, preferably 0.2 to 5 $\mu$m, and more preferably 0.3 to 3 $\mu$m. the weight ratio of the magnetic grains to the binder is preferably 0.5:100 to 60:100, and more preferably 1:100 to 30;100. The coating amount of the magnetic grains is 0.005 to 3 g/m$^2$, preferably 0.01 to 2 g/m$^2$, most preferably 0.02 to 0.5 g/m$^2$. The transmission yellow density of the magnetic recording layer is preferably 0.01 to 0.50, more preferably 0.03 to 0.20, and most preferably 0.04 to 0.15. The magnetic recording layer can be formed in the whole area of, or in the shape of stripes on, the back surface of a photographic support by coating or printing. The magnetic recording layer can be formed by any coating method using, e.g., an air doctor, a blade, an air knife, squeezing, impregnation, a reverse roll, a transfer roll, gravure, kissing, casting, spray, dipping, a bar or extrusion. A coating solution described in JP-A-5-341436 is preferable.

The magnetic recording layer may have additional functions such as improvement of lubricating property, adjustment of curling, electrostatic charge prevention, adhesion prevention and polish of head. Alternatively, an additional functional layer may be formed which performs these functions. A preferable polishing agent contains at least one type of aspherical inorganic grains which have a Mohs hardness of 5 or more. The composition of the aspherical inorganic grain is preferably an oxide, such as aluminum oxide, chromium oxide, silicon dioxide and titanium dioxide, carbide, such as silicon carbide and titanium carbide, or a fine powder of diamond. The surfaces of the grains constituting these polishing agents can be treated with a silane coupling agent or a titanium coupling agent. These grains can be added to the magnetic recording layer, or the magnetic recording layer can be overcoated with a layer containing these grains (e.g., as a protective layer or a lubricating layer). The binder to be used together with the grains can be of any of those described above and is preferably the same binder as in the magnetic recording layer. Light-sensitive materials having the magnetic recording layer are described in U.S. Pat. Nos. 5,336,589; 5,250,404; 5,229,259 and 5,215,874, and EP 466,130.

A polyester support to be used in the present invention is described below. Details of the polyester support, light-sensitive materials, treatment, cartridges and examples are described in Journal of Technical Disclosure No. 94-6,023 (JIII; Mar. 15, 1994). The polyester used in the present invention is made up of a diol and an aromatic dicarboxylic acid as essential components. Examples of the aromatic dicarboxylic acid include 2,6-, 1,5-, 1,4- and 2,7-naphthalenedicarboxylic acid, terephthalic acid, isophthalic acid and phthalic acid. Examples of the diol include diethyleneglycol, triethyleneglycol, cyclohexanedimethanol, bisphenol A and bisphenol. Examples of the polymer are homopolymers such as polyethylene terephthalate, polyethylene naphthalate and polycyclohexanedimethanol terephthalate. The polyester containing 50 to 100 mol% of 2,6-naphthalenedicarboxylic acid is particularly preferable. Polyethylene 2,6-naphthalate is most preferable among these polymers. The average molecular weight ranges between 5,000 and 200,000. Tg of the polyesters for use in the present invention is 50° C. or higher, preferably 90° C. or higher.

In order to make the polyester support more resistant to curling, the polyester support is heat-treated at a temperature within the range of from 40° C. to less than Tg, more preferably at a temperature within the range of from Tg–20° C. to less than Tg. The heat treatment can be performed at a fixed temperature within this range or can be performed together with cooling. The heat-treatment time is 0.1 to 1,500 hours, more preferably 0.5 to 200 hours. The heat treatment can be performed for a roll-like support or while the support is conveyed in the form of a web. Fine undulations (e.g., coating the surface with electroconductive inorganic fine grains such as $SnO_2$ or $Sb_2O_5$) may be given to the surface to improve the surface condition. It is also desirable to knurl and slightly raise the end portion, thereby preventing the shape of cut portion of the core from being transmitted. These heat treatments can be performed at any stage, for example, after support film formation, after surface treatment, after back layer coating (e.g., an antistatic agent or lubrication agent) and after the application of an undercoat. A preferable timing for the heat treatment is after the application of the antistatic agent.

An ultraviolet absorbent may be incorporated into this polyester. Also, the prevention of light piping can be achieved by incorporating the polyester with a dye or pigment, such as Diaresin manufactured by Mitsubishi Chemical Industries, Ltd. or Kayaset manufactured by Nippon Kayaku Co., Ltd., which is commercially available as an additive to polyester.

In the present invention, it is preferable to perform a surface treatment of the support in order to increase the bonding strength between the support and the light-sensitive material constituting layers. Examples of the surface treatment are surface activating treatments which include a chemical treatment, a mechanical treatment, a corona discharge treatment, a flame treatment, an ultraviolet treatment, a high-frequency treatment, a glow discharge treatment, an active plasma-treatment, a laser treatment, a mixed acid treatment and an ozone oxidation treatment. Preferred surface treatments are the ultraviolet irradiation treatment, the flame treatment, the corona treatment and the glow treatment.

The undercoat may consist of a single layer or two or more layers. Examples of the binder for the undercoat layer include a copolymer produced by using, as a starting material, a monomer selected from the group consisting of vinyl chloride, vinylidene chloride, butadiene, methacrylic acid, acrylic acid, itaconic acid, maleic anhydride and the like. Other examples include polyethyleneimine, an epoxy resin, grafted gelatin, nitrocellulose and gelatin. Resorcin and p-chlorophenyl are examples of a compound which swells the support. Examples of a gelatin hardner to be added to the undercoat layer include chromium salts (e.g., chromium alum), aldehydes (e.g., formaldehyde and glutaraldehyde), isocyanates, active halogenated compounds (e.g., 2,4-dichloro-6-hydroxy-s-triazine), epichlorohydrin resins and active vinylsulfones. The undercoat layer may contain $SiO_2$, $TiO_2$, inorganic fine grains or fine grains of a polymethyl methacrylate copolymer (0.01 to 10 $\mu$m) as a matting agent.

In the present invention, an antistatic agent is preferably used. Examples of the antistatic agent include polymers containing carboxylic acid group, carboxylate group or a sulfonate group, cationic polymers and ionic surfactant compounds.

It is most preferable to use as the antistatic agent at least one finely-divided crystalline metal oxide which is selected from the group consisting of ZnO, $TiO_2$, $SnO_2$, $Al_2O_3$, $In_2O_3$, $SiO_2$, MgO, BaO, $MoO_3$ and $V_2O_5$ and which has a volume resistivity of $10^7$ Ω·cm or less, more preferably $10^5$ Ω·cm or less, and a grain size of 0.001 to 1.0 μm, fine grains of composite oxides (e.g., Sb, P, B, In, S, Si and C) of these metal oxides, fine grains of sol metal oxides, or fine grains of composite oxides of these sol metal oxides.

The content in the light-sensitive material is preferably 5 to 500 mg/$m^2$, and most preferably 10 to 350 mg/$m^2$. The weight ratio of an electroconductive crystalline oxide or its composite oxide to the binder is preferably 1/300 to 100/1. and more preferably 1/100 to 100/5.

The light-sensitive material of the present invention preferably has a slip property. Slip agent-containing layers are preferably formed on the surfaces of both a light-sensitive layer and a back layer. A preferable slip property is indicated by a coefficient of kinetic friction of 0.01 to 0.25. This value represents the value that is obtained when a sample is conveyed at a speed of 60 cm/min while keeping contact with a stainless steel ball having a diameter of 5 mm (25° C., 60% RH). In this evaluation, a value of nearly the same level is obtained even when the stainless steel ball is replaced with the surface of a light-sensitive layer.

Examples of the slip agent usable in the present invention are polyorganosiloxanes, higher fatty acid amides, metals salts of higher fatty acids, and esters of higher fatty acids and higher alcohols. Examples of the polyorganosiloxanes include polydimethylsiloxane, polydiethylsiloxane, polystyrylmethylsiloxane and polymethylphenylsiloxane. A layer to which the slip agent is added is preferably the outermost emulsion layer or the back layer. Polydimethylsiloxanes or esters having a long-chain alkyl group are particularly preferable.

The light-sensitive material of the present invention preferably contains a matting agent. Although the matting agent can be added to either the emulsion surface or the back surface, it is most preferably added to the outermost layer on the side having the emulsion layer. The matting agent can be either soluble or insoluble in the processing solutions, and the use of a combination of both types of the matting agents is preferable. Preferable examples are polymethylmethacrylate grains, poly(methylmethacrylate/methacrylic acid =9:1 or 5/5 (molar ratio)) grains and polystyrene grains. The grain size is preferably 0.8 to 10 μm, and a narrow grain size distribution is preferable. It is preferable that 90% or more by number of all of the grains have grain sizes of 0.9 to 1.1 times the average grain size. To increase the matting effect, it is preferable to simultaneously add fine grains having a grain size of 0.8 μm or less, examples of which include polymethylmethacrylate grains (0.2 μm), poly (methylmethacrylate/methacrylic acid =9/1 (molar ratio) grains (0.3 μm), polystyrene grains (0.25 μm) and colloidal silica (0.03 μm).

A film cartridge to be used in the present invention is described below. The principal material of the cartridge to be used in the present invention can be a metal or synthetic plastic.

Examples of preferable plastic materials include polystyrene, polyethylene, polypropylene and polyphenylene ether. The cartridge of the present invention can also contain various antistatic agents. For this purpose, carbon black, metal oxide grains, nonionic, anionic, cationic or betaine surfactants, or polymers can be preferably used. These cartridge subjected to the antistatic treatment are described in JP-A-1-312537 and JP-A-312538. It is particularly preferable that the resistance be $10^{12}$ Ω or less at 25° C. and 25% RH. Commonly, plastic cartridges are manufactured by using plastics into which carbon black or pigments are incorporated to give a light-shielding property. The cartridge size can be a presently available 135 size. For the purpose of down-sizing the cameras, it is effective to decrease the diameter of 25-mm cartridge of 135 size to 22 mm or less. The volume of a cartridge case is 30 $cm^3$ or less, preferably 25 $cm^3$ or less. The weight of the plastic used in the cartridge and the cartridge case is preferably 5 to 15 g.

Furthermore, a cartridge which feeds a film by rotating a spool can be used in the present invention. It is also possible to use a structure in which a film leader is housed in a cartridge main body and fed through a port of the cartridge to the outside by rotating a spool shaft in the film feed direction. These structures are disclosed in U.S. Pat. Nos. 4,834,306 and 5,226,613. Photographic films to be used in the present invention can be so-called raw films before being developed or developed photographic films. Also, raw and developed photographic films can be accommodated in the same new cartridge or in different cartridge.

The color photographic light-sensitive material of the present invention is also suitable as a negative film for use in Advanced Photo System (hereinafter referred to AP system) and examples of which are formed by processing films in AP system format like NEXIA A, NEXIA F and NEXIA H (in this order; ISO 200/100/400) manufactured by Fuji Photographic Film, Ltd. (hereinafter referred to Fuji Film) and accommodating them in an exclusive cartridge. These cartridge films for use in AP system are used by charging into cameras for AP system such as Epion Series (such as Epion 300Z) manufactured by Fuji Film. In addition, the color photographic light-sensitive material of the present invention is also suitable for films with a lens such as "Fiji Color UTSURUNDESU, Super Slim" manufactured by Fuji Film.

The films photographed by them are printed in Mini Lab System through the following steps.

(1) Receiving (Receiving of the exposed cartridge film from a customer)
(2) Detachment step (The film is transferred from the cartridge to an intermediate cartridge for developing step)
(3) Film development
(4) Reattachment step (The developed negative film is returned to the original cartridge)
(5) Print (C/H/P three types of prints and an index print are printed successively and automatically printed on color print papers (preferably SUPER FA8 manufactured by Fuji Film)
(6) Collation and shipment (The cartridge and the index print are collated using ID number and shipped together with the print)

The preferable system for this is Fuji Film Mini Lab Champion Super FA-298/FA-278/FA-258/FA-238 and Fuji Film Digital Lab System Frontier. An example of a film processor for Mini Lab Champion includes FP922AL/FP562B/FP562B, AL/FP362B/FP362B, AL and the recommended treating chemicals is Fuji Color Just It CN-16 and CN-16Q. An example of a printer processor includes PP3008AR/PP3008A/PP1828AR/PP1828A/PP1258AR/PP1258A/PP728AR/PP728A and the recommended treating chemicals is Fiji Color Just It CP-47L and CP-40FAII. In Frontier System, Scanner & Image Processor SP-1000 and Laser Printer & Paper Processor LP-1000P or Laser Printer LP-1000W are used. The preferable detacher used in detachment step and the preferable reattacher used in reattachment step are DT200/DT100 and AT200/AT100 manufactured by Fuji Film, respectively.

AP system can be also enjoyed by Photo Joint System, a principle of which is Fuji Film, Digital Image Work Station, Aladdin 1000. The resultant digital image data can be easily processed and compiled by directly charging the developed AP system cartridge film into Aladdin 1000 or inputting image informations of a negative film, a positive film and a print using a 35 mm film scanner, FE-550 or a flight head scanner, PE-550. The data can be outputted as a print by a digital color printer, NC-550AL in a manner of a light fixing type heat-sensitive color print or pictrography 3000 in a manner of laser exposure heat development transfer, or by the known lab machine through a film recorder. Alternatively, in Aladdin 100, digital informations can be inputted directly into a floppy disk and Zip disk or into CD-R through CD writer.

On the other hand, at homes, photographs can be enjoyed through TV simply by charging the developed AP system cartridge film into a photo-player AP-1 manufactured by Fuji Film, or alternatively, image informations can be incorporated into a personal computer at a high speed by charging the above cartridge film into a photo scanner AS-1 manufactured by Fiji Film. In addition, in order to input a film, a print or a solid into a personal computer, a photo-vision FV-10/FV-5 manufactured by Fiji Film can be utilized. Further, image informations recorded on a floppy disk, Zip disk, CD-R or a hard disk can be enjoyed by processing in a variety ways on a personal computer using Fuji, Application Software Photo-Factory. In order to output a high quality print from a personal computer, a digital color printer NC-2/NC-2D in a manner of light fixing type heat-sensitive color print manufactured by Fuji Film is suitable.

In order to accommodate the developed AP system cartridge film, Fuji Color, a pocket albums, AP-5 Pop L, AP-1 Pop L and AP-1 Pop KG or a cartridge film 16 are preferable.

EXAMPLE

The present invention will be explained in more detail below by reference to the following example. However, the present invention is not limited to this example as long as the invention does not depart from the scope of the present invention.

Example 1

The following compositions were coated on cellulose triacetate films to prepare a sample 101.

(Compositions of light-sensitive layers)

The main materials used in the individual layers were classified as follows.

ExC: Cyan coupler, UV: Ultraviolet absorbent

ExM: Magenta coupler, HBS: High-boiling organic solvent

ExY: Yellow coupler, H: Gelatin hardner

ExS: Sensitizing dye

The number corresponding to each component indicates the coating amount in units of g/m$^2$. The coating amount of a silver halide is represented by the amount of silver. The coating amount of each sensitizing dye is represented in units of mol per mol of silver halide in the same layer.

(Sample 101)

1st layer (1st antihalation layer)

| | |
|---|---|
| Black colloidal silver | silver 0.075 |
| Gelatin | 0.70 |
| ExC-2 | 0.05 |

2nd layer (Auxiliary light-sensitive layer)

| | |
|---|---|
| Silver iodobromide emulsion D | silver 0.18 g/m$^2$ |
| ExS-1 | $1.0 \times 10^{-4}$ |
| ExS-2 | $4.0 \times 10^{-6}$ |
| ExS-3 | $1.4 \times 10^{-3}$ |
| Gelatin | 0.5 |
| ExC-1 | 0.04 |
| ExC-4 | 0.03 |
| Cpd-2 | 0.01 |

3rd layer (2nd antihalation layer)

| | |
|---|---|
| Black colloidal silver | silver 0.28 |
| Gelatin | 1.90 |
| ExM-1 | 0.10 |
| ExF-1 | $2.0 \times 10^{-3}$ |
| Solid dispersion dye ExF-2 | 0.030 |
| Solid dispersion dye ExF-3 | 0.040 |
| HBS-1 | 0.15 |
| HBS-2 | 0.02 |

4th layer (Low-speed red-sensitive emulsion layer)

| | |
|---|---|
| Silver iodobromide emulsion A | silver 0.02 |
| Silver iodobromide emulsion B | silver 0.05 |
| ExS-1 | $3.3 \times 10^{-4}$ |
| ExS-2 | $1.4 \times 10^{-5}$ |
| ExS-3 | $4.6 \times 10^{-4}$ |
| ExC-1 | 0.11 |
| ExC-2 | 0.02 |
| ExC-3 | 0.04 |
| ExC-4 | 0.07 |
| ExC-5 | 0.020 |
| ExC-6 | 0.10 |
| ExM-4 | 0.005 |
| ExY-1 | 0.01 |
| Cpd-2 | 0.025 |
| HBS-1 | 0.10 |
| Gelatin | 1.10 |

5th layer (Medium-speed red-sensitive emulsion layer)

| | |
|---|---|
| Silver iodobromide emulsion B | silver 0.38 |
| Silver iodobromide emulsion C | silver 0.38 |
| ExS-1 | $4.2 \times 10^{-4}$ |
| ExS-2 | $1.8 \times 10^{-5}$ |
| ExS-3 | $5.9 \times 10^{-4}$ |
| ExC-1 | 0.18 |
| ExC-2 | 0.05 |
| ExC-3 | 0.06 |
| ExC-4 | 0.07 |
| ExC-5 | 0.02 |
| ExC-6 | 0.02 |
| ExM-4 | 0.03 |
| ExY-1 | 0.006 |
| Cpd-4 | 0.02 |
| Cpd-2 | 0.02 |
| HBS-1 | 0.10 |
| Gelatin | 0.90 |

6th layer (High-speed red-sensitive emulsion layer)

| | |
|---|---|
| Silver iodobromide emulsion D | silver 0.26 |
| ExS-1 | $3.5 \times 10^{-4}$ |
| ExS-2 | $1.5 \times 10^{-5}$ |
| ExS-3 | $4.9 \times 10^{-4}$ |
| ExC-1 | 0 02 |
| ExC-2 | 0.018 |
| ExC-3 | 0.0015 |
| ExC-6 | 0.001 |
| ExC-7 | 0.010 |
| ExM-4 | 0.003 |
| Cpd-2 | 0.040 |
| Cpd-4 | 0.040 |
| HBS-1 | 0.22 |
| HBS-2 | 0.050 |
| Gelatin | 1.10 |

7th layer (Interlayer)

| | |
|---|---|
| Cpd-1 | 0.060 |
| Solid dispersion dye ExF-4 | 0.030 |
| HBS-1 | 0.040 |
| Polyethyl acrylate latex | 0.15 |
| Gelatin | 1.10 |

8th layer (low-speed green-sensitive emulsion layer)

| | |
|---|---|
| Silver iodobromide emulsion E | silver 0.15 |
| Silver iodobromide emulsion F | silver 0.102 |
| Silver iodobromide emulsion G | silver 0.15 |
| ExS-7 | $7.5 \times 10^{-4}$ |
| ExS-8 | $3.4 \times 10^{-4}$ |
| ExS-4 | $2.5 \times 10^{-5}$ |
| ExS-5 | $9.0 \times 10^{-5}$ |
| ExS-6 | $4.3 \times 10^{-4}$ |
| ExM-3 | 0.30 |
| ExM-4 | 0.09 |
| ExY-1 | 0.01 |
| ExY-5 | 0.0020 |
| HBS-1 | 0.30 |
| HBS-3 | 0.015 |
| Cpd-4 | 0.010 |
| Gelatin | 0.95 |

9th layer (medium-speed green-sensitive emulsion layer)

| | |
|---|---|
| Silver iodobromide emulsion G | silver 0.2 |
| Silver iodobromide emulsion H | silver 0.2 |
| ExS-4 | $3.6 \times 10^{-5}$ |
| ExS-7 | $1.7 \times 10^{-4}$ |
| ExS-8 | $8.0 \times 10^{-4}$ |
| ExC-8 | 0.0020 |
| ExM-3 | 0.12 |
| ExM-4 | 0.02 |
| ExY-1 | 0.02 |
| ExY-4 | 0.005 |
| ExY-5 | 0.002 |
| Cpd-4 | 0.015 |
| HBS-1 | 0.13 |
| HBS-3 | $4.4 \times 10^{-3}$ |
| Gelatin | 0.80 |

10th layer (high-speed green-sensitive emulsion layer)

| | |
|---|---|
| Silver iodobromide emulsion I | silver 0.28 |
| ExS-4 | $6.3 \times 10^{-5}$ |
| ExS-7 | $1.7 \times 10^{-4}$ |
| ExS-8 | $7.8 \times 10^{-4}$ |
| ExC-6 | 0.01 |
| ExM-4 | 0.02 |

-continued

| | |
|---|---|
| ExM-2 | 0.005 |
| ExM-5 | 0.001 |
| ExM-6 | 0.001 |
| ExM-3 | 0.04 |
| Cpd-3 | 0.001 |
| Cpd-4 | 0.040 |
| HBS-1 | 0.25 |
| Polyethylacrylate latex | 0.15 |
| Gelatin | 1.33 |

11th layer (Yellow filter layer)

| | |
|---|---|
| Yellow colloidal silver | silver 0.015 |
| Cpd-1 | 0.16 |
| Solid dispersion dye ExF-5 | 0.060 |
| Solid dispersion dye ExF-6 | 0.060 |
| Oil-soluble dye EXF-7 | 0.010 |
| HBS-1 | 0.60 |
| Gelatin | 0.60 |

12th layer (low-speed blue-sensitive emulsion layer)

| | |
|---|---|
| Silver iodobromide emulsion J | silver 0.06 |
| Silver iodobromide emulsion K | silver 0.06 |
| Silver iodobromide emulsion L | silver 0.15 |
| ExS-9 | $8.4 \times 10^{-4}$ |
| ExC-1 | 0.03 |
| ExC-8 | $7.0 \times 10^{-3}$ |
| ExY-1 | 0.07 |
| ExY-2 | 0.72 |
| ExY-3 | 0.02 |
| ExY-4 | 0.01 |
| Cpd-2 | 0.005 |
| Cpd-4 | 0.005 |
| Cpd-3 | 0.004 |
| UV-2 | 0.054 |
| UV-3 | 0.054 |
| HBS-1 | 0.28 |
| Gelatin | 2.60 |

13th layer(high-speed blue-sensitive emulsion layer)

| | |
|---|---|
| Silver iodobromide emulsion M | silver 0.24 |
| ExS-9 | $6.0 \times 10^{-4}$ |
| ExY-2 | 0.005 |
| ExY-3 | 0.24 |
| ExY-4 | 0.0050 |
| Cpd-2 | 0.10 |
| Cpd-3 | $1.0 \times 10^{-3}$ |
| Cpd-4 | $5.0 \times 10^{-3}$ |
| UV-2 | 0.012 |
| UV-3 | 0.012 |
| HBS-1 | 0.075 |
| Gelatin | 0.55 |

14th layer (1st protective layer)

| | |
|---|---|
| Silver iodobromide emulsion N | silver 0.10 |
| UV-1 | 0.13 |
| UV-2 | 0.10 |
| UV-3 | 0.16 |
| UV-4 | 0.025 |
| ExF-8 | 0.03 |
| ExF-9 | 0.005 |
| ExF-10 | 0.005 |
| ExF-11 | 0.02 |
| HBS-1 | $5.0 \times 10^{-2}$ |
| HBS-4 | $5.0 \times 10^{-2}$ |
| Gelatin | 1.8 |

15th layer (2nd protective layer)

| | |
|---|---|
| H-1 | 0.40 |
| B-1 (diameter 1.7 μm) | 0.04 |
| B-1 (diameter 1.7 μm) | 0.09 |
| B-3 | 0.13 |
| ES-1 | 0 20 |
| Gelatin | 0.70 |

In addition to the above components, to improve storage stability, processability, a resistance to pressure, antiseptic and mildewproofing properties, antistatic properties and coating properties, the individual layers contained W-1 to W-3, B-4 to B-6, F-1 to F-18, iron salt, lead salt, gold salt, platinum salt, iridium salt and rhodium salt.

The average AgI contents and grain sizes of the emulsions A–N used in the above-mentioned sample 101 are shown in the following Table 1.

TABLE 1

| Emulsion | Average AgI content (%) | Equivalent-sphere diameter of average grain diameter (μm) | Coefficient of variation with grain diameter (%) | Equivalent-circle diameter of projected area (μm) | ratio of diameter/thickness | Tabularity |
|---|---|---|---|---|---|---|
| A | 2.8 | 0.28 | 13 | 0.28 | 1.5 | 8 |
| B | 3.7 | 0.43 | 19 | 0.58 | 3.2 | 18 |
| C | 5.0 | 0.55 | 20 | 0.86 | 6.2 | 45 |
| D | 5.4 | 0.66 | 23 | 1.10 | 7.0 | 45 |
| E | 2.8 | 0.28 | 13 | 0.28 | 1.5 | 8 |
| F | 3.7 | 0.43 | 19 | 0.58 | 3.2 | 18 |
| G | 5.4 | 0.55 | 20 | 0.86 | 6.2 | 45 |
| H | 5.4 | 0.66 | 23 | 1.10 | 7.0 | 45 |
| I | 5.4 | 0.72 | 23 | 1.10 | 6.3 | 36 |
| J | 3.7 | 0.37 | 19 | 0.55 | 4.6 | 38 |
| K | 3.7 | 9.37 | 19 | 0.55 | 4.6 | 38 |
| L | 8.8 | 0.64 | 23 | 0.85 | 5.2 | 32 |
| M | 6.8 | 0.88 | 30 | 1.12 | 4.7 | 20 |
| N | 1.0 | 0.07 | — | — | 1.0 | — |

In Table 1, (1) The emulsions J to M were subjected to reduction sensitization during grain preparation by use of thiourea dioxide and thiosulfonic acid in accordance with the examples described in JP-A-2-191938.

(2) The emulsions C to E, emulsion G to I and emulsion M were subjected to gold sensitization, sulfur sensitization and selenium sensitization in the presence of a spectral sensitizing dye described in the individual light-sensitive layers and sodium thiocyanate in accordance with the examples described in JP-A-3-237450.

(3) Low-molecular-weight gelatin was used for the preparation of tabular grains according to the examples described in JP-A-1-158426.

(4) Under a high-voltage electronic microscope, dislocation lines similar to those described in JP-A-3-327450 were observed on the tabular grains.

(5) The emulsions A to E, emulsions G and H, and emulsions J to M contain an optimal amounts of Rh, Ir and Fe. The tabularity is defined by $Dc/t^2$, where Dc represents an equivalent-circle average diameter of the projected area of a tabular grain, and t represents the average thickness of tabular grains.

Preparation of dispersions of organic solid dispersions dyes

ExF-2 was prepared by the following method. 21.7 mL of water, 3 mL of 5% aqueous solution of p-octylphenoxyethoxyethoxyethanesulfonic acid soda, and 0.5g of a 5% aqueous solution of p-octylphenoxypolyoxyethylene ether (polymerization degree: 10) were placed in a 700 mL pot mill, and 5.0 g of dye ExF-2 and 500 mL of zirconium oxide beads (diameter: 1 mm) were added to the mill. The contents were dispersed for 2 hours by using a BO-type vibration mill manufactured by Chuo Koki Co., Ltd. After the dispersing operation, the contents were taken out and were added to 8 g of a 12.5% aqueous gelatin solution. The beads were removed by filtration from the resultant material, thus obtaining a dispersion of the dye in gelatin. The average grain diameter of the finely-dispersed dye grains was 0.44 μm.

Following the same procedures as above, solid dispersions ExF-3, ExF-4 and ExF-6 were obtained. The average grain sizes of these finely-dispersed dye grains were 0.24 μm, 0.45 μm and 0.52 μm, respectively. ExF-5 was dispersed by a micro-precipitation dispersion method described in Example 1 of EP 549,489A. The average grain size was found to be 0.06 μm.

The compounds used in the formation of the layers in Sample 101 are as follows.

ExC-1
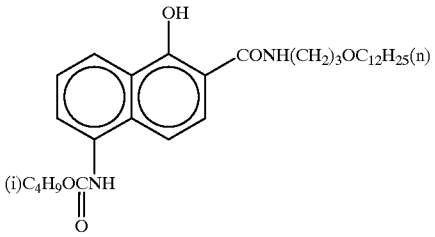
ExC-2
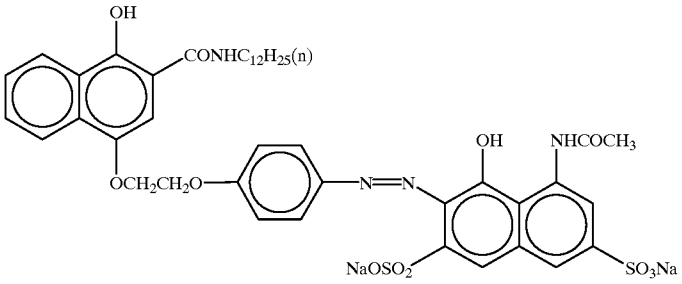
ExC-3
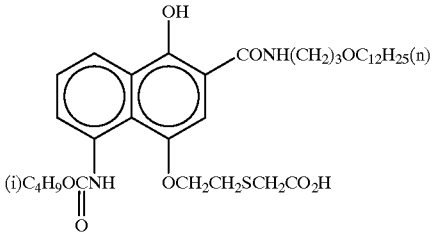
ExC-4
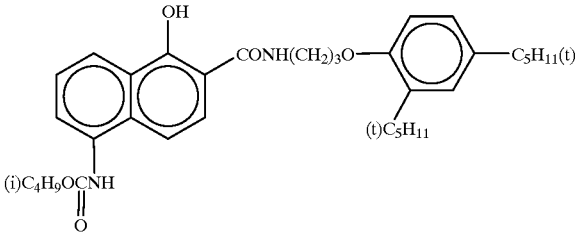
ExC-5
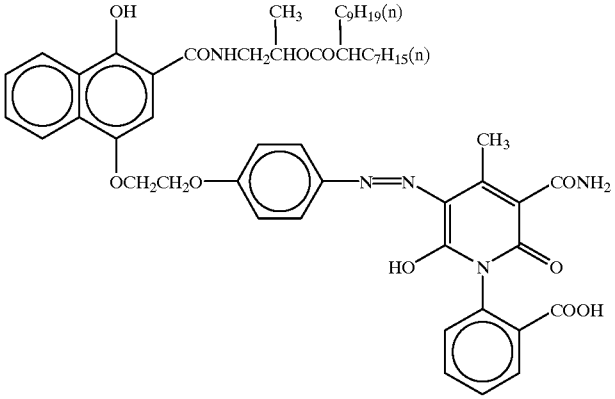

-continued
ExC-6
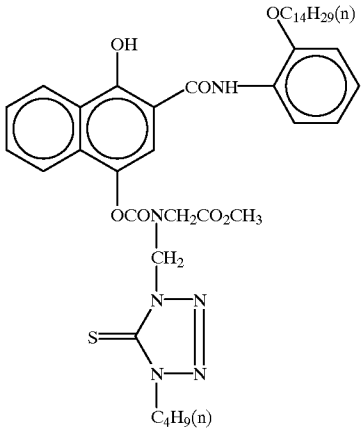
ExC-7
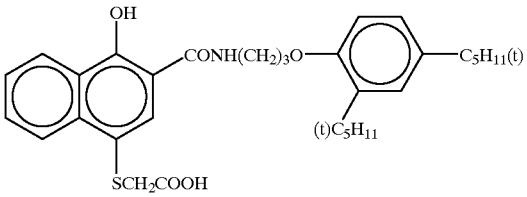
ExC-8
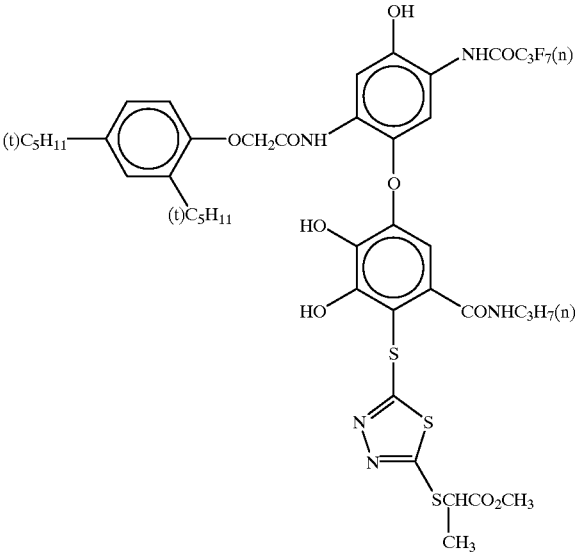
ExM-1
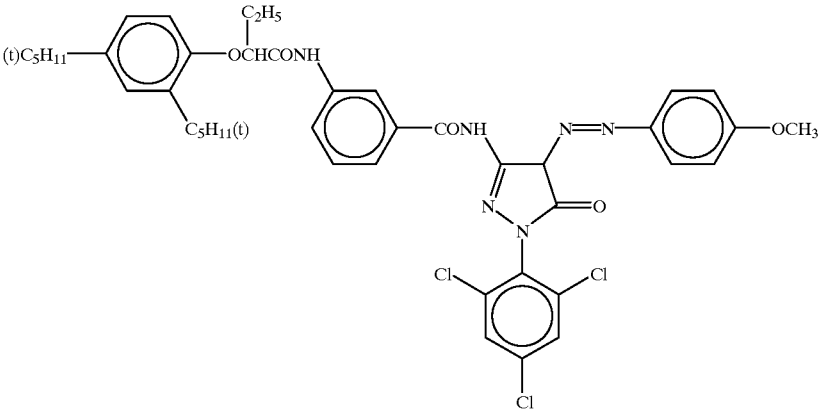

-continued
ExM-2
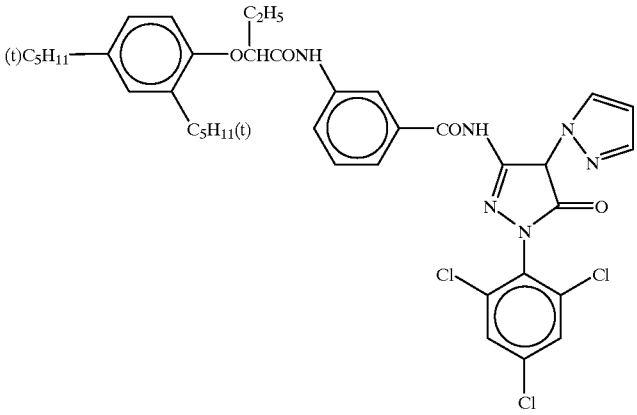
ExM-3
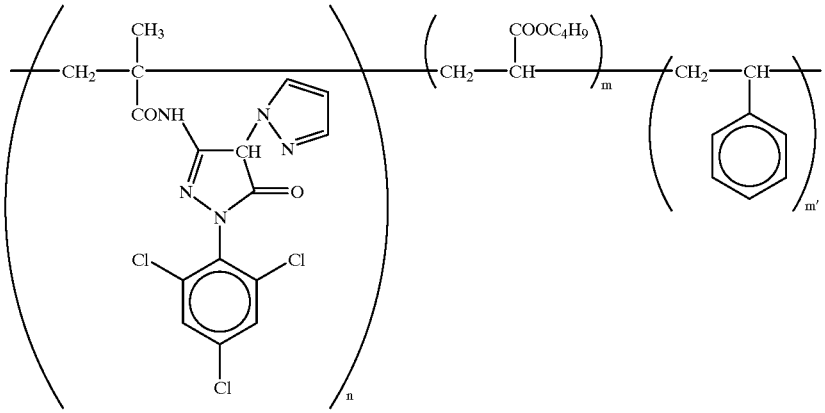
n = 50
m = 25
m′ = 25
mol. wt. about 20,000
ExM-4
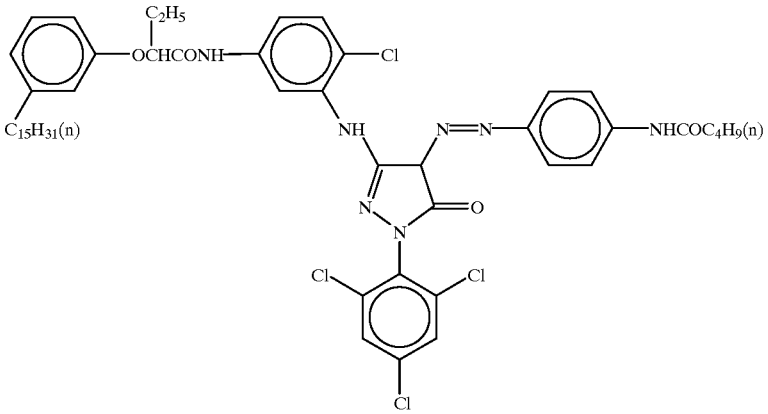
ExM-5
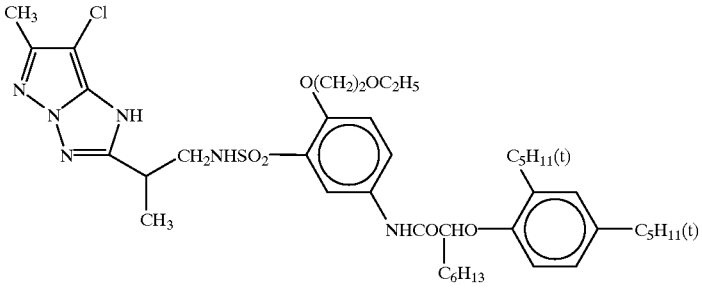

-continued
ExM-6
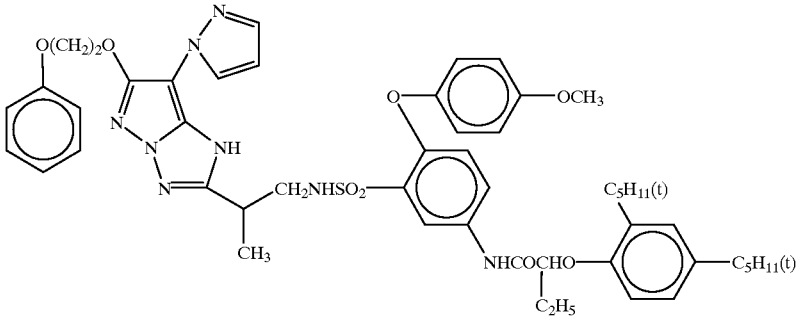
ExY-1
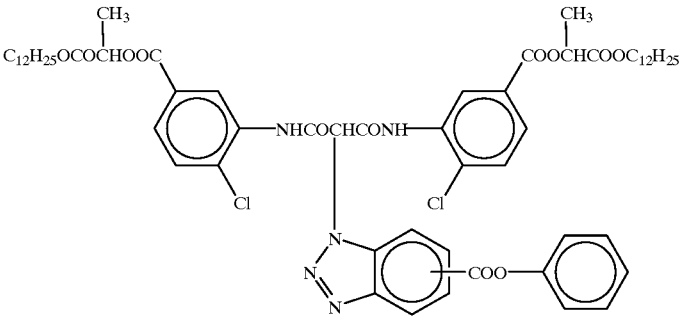
ExY-2
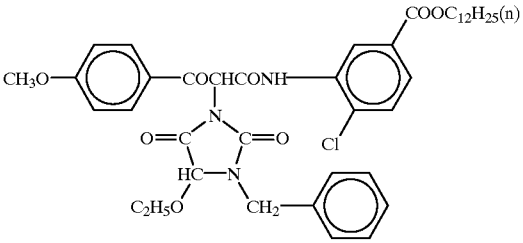
ExY-3
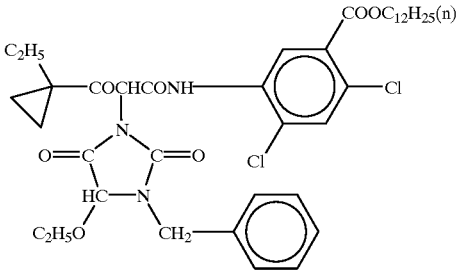
ExY-4
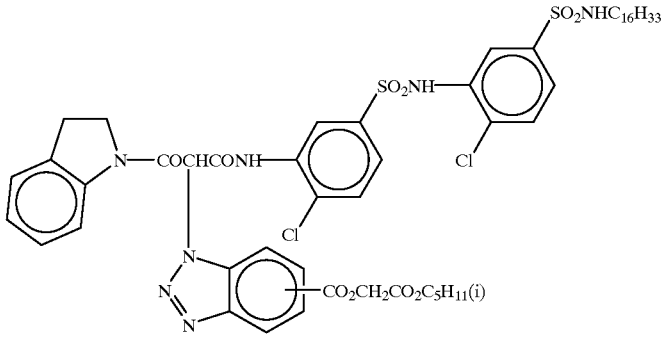

-continued
ExY-5
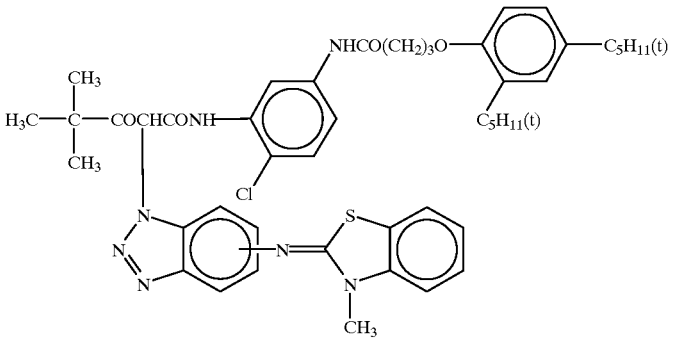
ExF-1
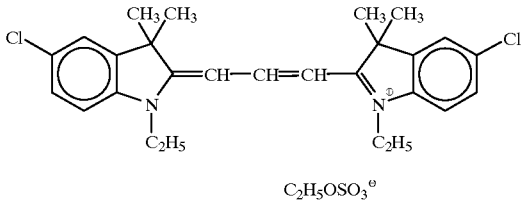
ExF-2
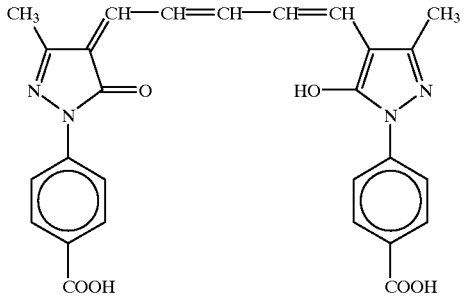
ExF-3
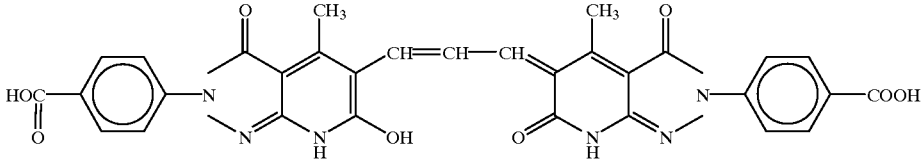
ExF-4
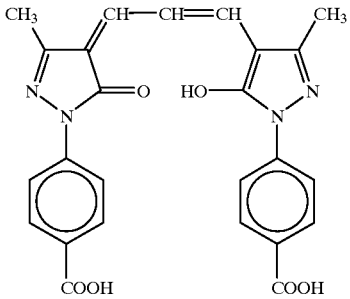
ExF-5
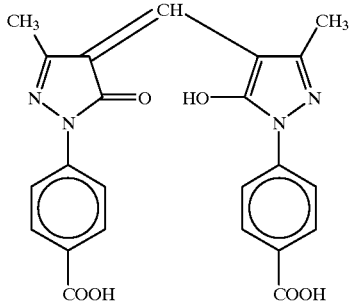
ExF-6
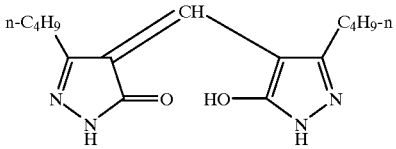
ExF-7
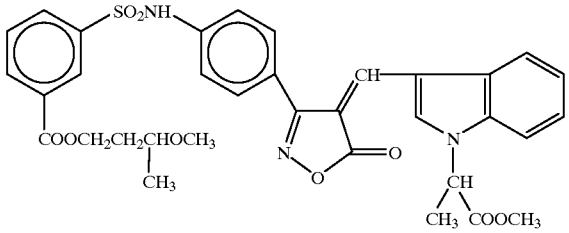

-continued
ExF-8
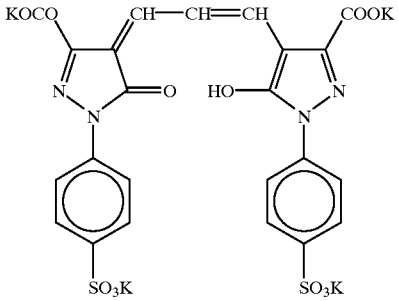
ExF-9
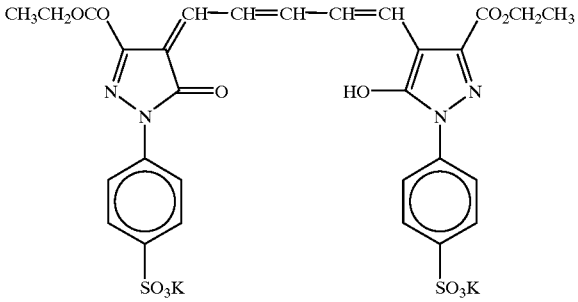
ExF-10
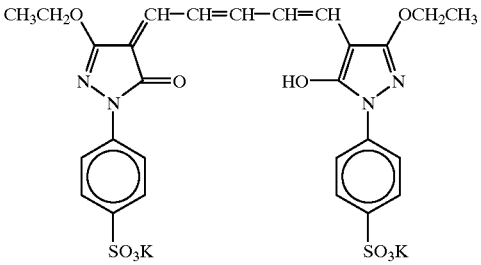
ExF-11
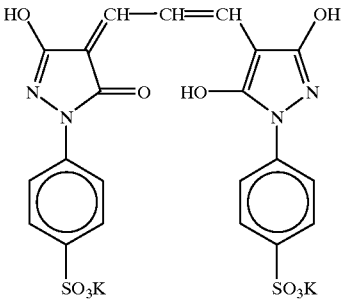
Cpd-1
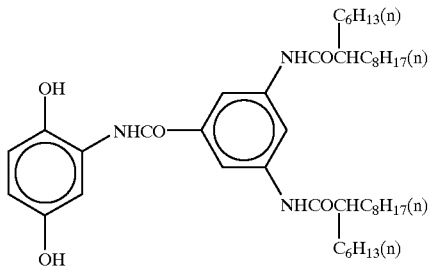
Cpd-2
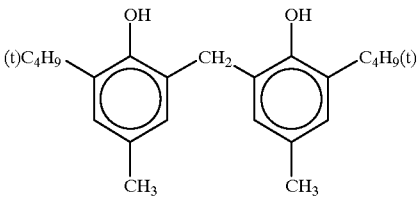
Cpd-3
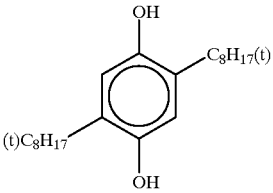
Cpd-4
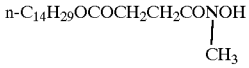
UV-1
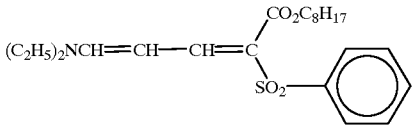
UV-2
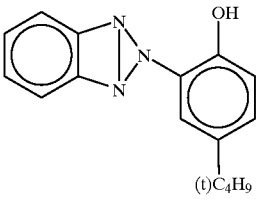
UV-3
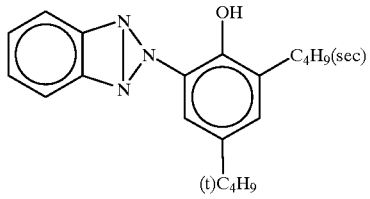
UV-4
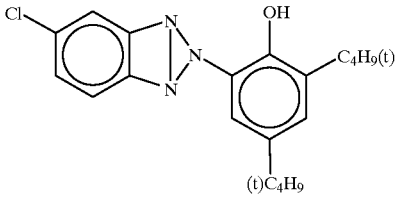
HBS-1
Tricresyl phosphate
HBS-2
Di-n-butylphthalate -continued
HBS-3
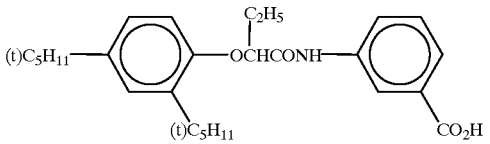
HBS-4
Tri(2-ethylhexyl)phosphate
ExS-1
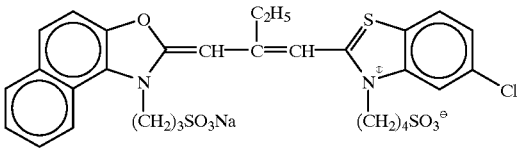
ExS-2
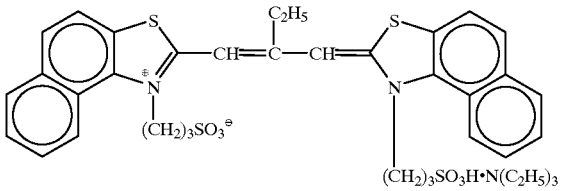
ExS-3
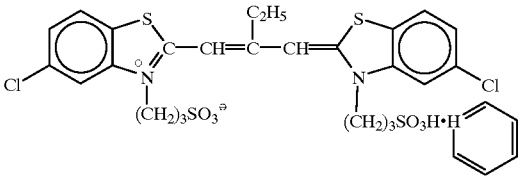
ExS-4
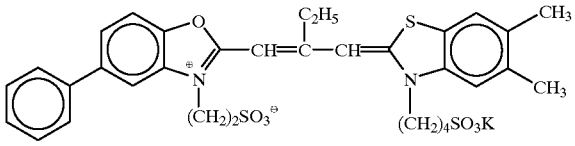
ExS-5
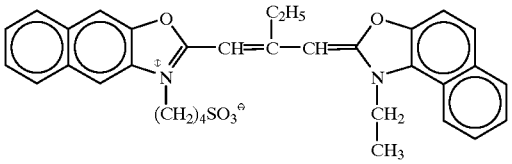
ExS-6
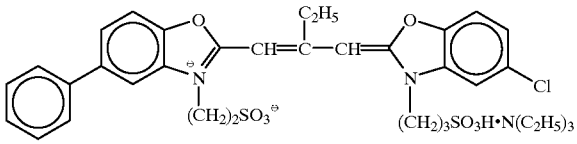
ExS-7
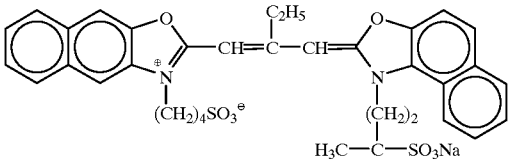
ExS-8
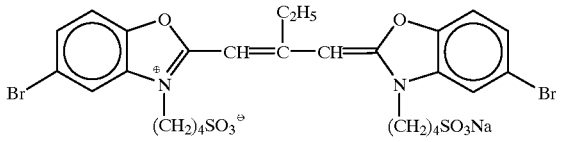
ExS-9
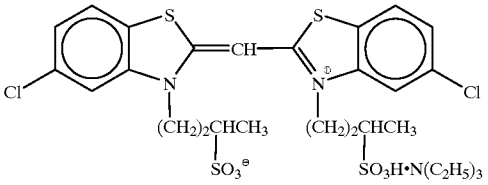
ES-1
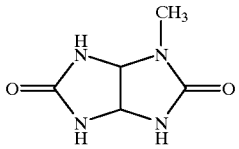
H-1
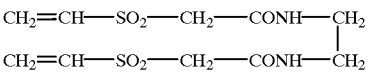
B-1
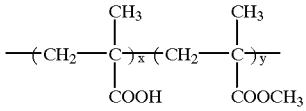
x/y = 10/90
Average molecular weight: about 35,000
B-2
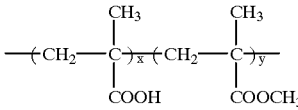
x/y = 45/55
Average molecular weight: about 20,000
B-3
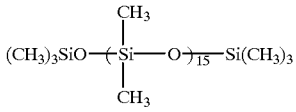

-continued
B-4
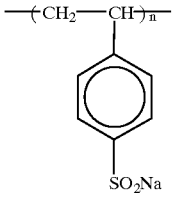
Average molecular weight: about 750,000
B-5
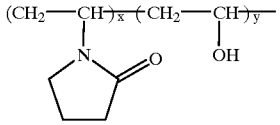
x/y = 70/30
Average molecular weight: about 17,000
B-6
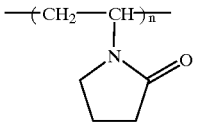
Average molecular weight: about 10,000
W-1
$C_8F_{17}SO_2NHCH_2CH_2CH_2OCH_2CH_2N^{\oplus}(CH_3)_3$
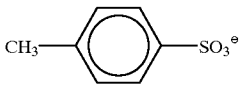
W-2
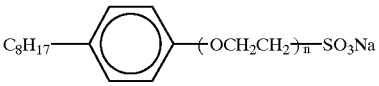
n = 2 to 4
W-3
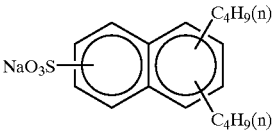
F-1
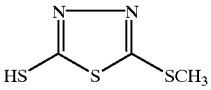
F-2
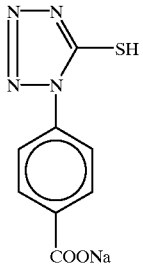
F-3
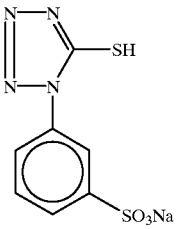
F-4
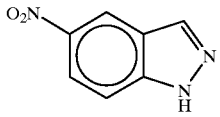
F-5
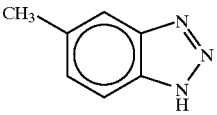
F-6
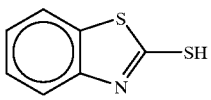
F-7
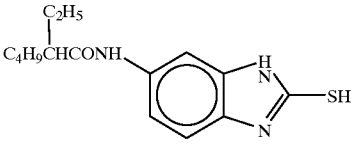
F-8
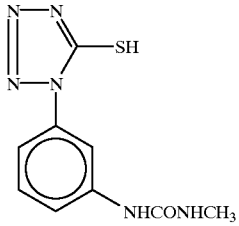

-continued

F-9

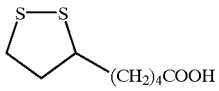

F-10

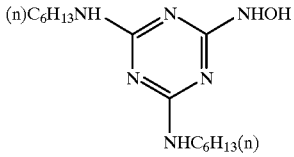

F-11

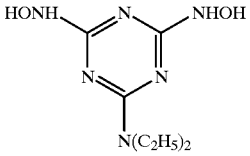

F-12

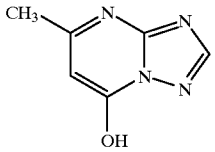

F-13

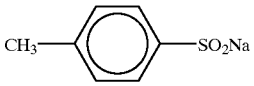

F-14

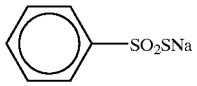

F-15

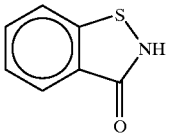

F-16

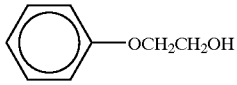

F-17

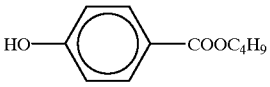

F-18

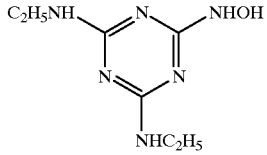

As shown in the following Table 2, samples 102 to 105 were prepared following the same procedure as in the preparation of the sample 101 except that the film thickness of the 3rd layer was changed in the sample 101. Sample 106 was prepared following the same procedure as in the preparation of the sample 101 except that the film thickness of the 1st layer and that of the 3rd layer were changed in the sample 101. Samples 107 and 108 were prepared following the same procedure as in the preparation of the sample 101 except that the film thickness of the 12th sample and that of the 13th layer were changed in the samples 105 and 106, respectively. Samples 109 and 110 were prepared following the same procedure as in the preparation of the sample 101 except that the film thickness of the 1st layer and that of the 3rd layer were changed in the sample 101, respectively.

The film thickness was changed by changing the coating amount of gelatin.

The samples thus prepared above were subjected to wedge exposure using white light and a developing processing described below, and then the minimum density (fog density) was measured.

The smaller this density, the smaller a change in fog with a change in processing and processing unevenness.

The results are shown in Table 2 below.

TABLE 2

| | 1st layer | | | 3rd layer | | |
|---|---|---|---|---|---|---|
| Sample No. | Coating amount of colloidal silver A(g/m$^2$) | Film thickness T($\mu$m) | A/T | Coating amount of colloidal silver A(g/m$^2$) | Film thickness T($\mu$m) | A/T |
| 101 | 0.075 | 0.57 | 0.13 | 0.28 | 1.76 | 0.16 |
| 102 | 0.075 | 0.57 | 0.13 | 0.28 | 1.56 | 0.18 |
| 103 | 0.075 | 0.57 | 0.13 | 0.28 | 1.27 | 0.22 |
| 104 | 0.075 | 0.57 | 0.13 | 0.28 | 1.12 | 0.25 |
| 105 | 0.075 | 0.57 | 0.13 | 0.28 | 0.93 | 0.30 |
| 106 | 0.075 | 0.30 | 0.25 | 0.28 | 0.93 | 0.30 |
| 107 | In the sample 105, yellow couplers of 12th and 13th layers were replaced by Y-5 of 1.2-time molar amount. | | | | | |
| 108 | In the sample 106, yellow couplers of 12th and 13th layers were replaced by Y-5 of 1.2-time molar amount. | | | | | |

TABLE 2-continued

| | | | | | | |
|---|---|---|---|---|---|---|
| 109 | 0.075 | 0.30 | 0.25 | 0.33 | 0.93 | 0.35 |
| 110 | 0.075 | 0.30 | 0.25 | 0.36 | 0.93 | 0.39 |

| Sample | Dmin | | | |
|---|---|---|---|---|
| No. | Y | M | C | Remarks |
| 101 | 0.14 | 0.12 | 0.18 | Comparative example |
| 102 | 0.13 | 0.11 | 0.17 | Comparative example |
| 103 | 0.10 | 0.08 | 0.14 | Comparative example |
| 104 | 0.09 | 0.07 | 0.13 | Present invention |
| 105 | 0.08 | 0.07 | 0.12 | Present invention |
| 106 | 0.07 | 0.06 | 0.10 | Present invention |
| 107 | 0.06 | 0.07 | 0.12 | Present invention |
| 108 | 0.05 | 0.06 | 0.10 | Present invention |
| 109 | 0.08 | 0.07 | 0.10 | Present invention |
| 110 | 0.08 | 0.07 | 0.10 | Present invention |

As is apparent from the results shown in Table 2, the fog density of the samples of the present invention is low.

(Processing steps)

| Step | Time | Temperature |
|---|---|---|
| Color development | 3 min 15 sec | 38° C. |
| Bleaching | 1 min 0 sec | 38° C. |
| Bleaching fixing | 3 min 15 sec | 38° C. |
| Water washing (1) | 40 sec | 35° C. |
| Water washing (2) | 1 min 0 sec | 35° C. |
| Stabilizing | 40 sec | 38° C. |
| Drying | 1 min 15 sec | 55° C. |

The compositions of the processing solutions are shown below.

| | (unit: g) |
|---|---|
| (Color developing solution) | |
| Diethylenetriaminepentaacetic acid | 1.0 |
| 1-hydroxyethylidene-1,1-diphosphonic acid | 2.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-(N-ethyl-N-(β-hydroxyethyl)amino) 2-methylaniline sulfate | 4.5 |
| Water to make | 1.0 L |
| pH (controlled by potassium hydroxide and sulfuric acid) | 10.05 |
| (Bleaching solution) | |
| Ferric sodium ethylenediaminetetraacetate Dihydrate | 120.0 |
| Disodium ethylenediaminetetraacetate | 10.0 |
| Ammonium bromide | 100.0 |
| Amnonium nitrate | 10.0 |
| Bleaching promoting agent $(CH_3)_2N—CH_2—CH_2—S—S—CH_2—CH_2—N(CH_3)_2.2HCl$ | 0.005 mol |
| Ammonia water (27%) | 15.0 mL |
| Water to make | 1.0 L |
| pH (controlled by ammonia water and nitric acid) | 6.3 |
| (Bleaching fixing solution) | |
| Ferric ammionium ethylenediaminetetraacetate Dihydrate | 50.0 |
| Disodium ethylenediaminetetraacetate | 5.0 |
| Sodiuin sulfite | 12.0 |

-continued

| | (unit: g) |
|---|---|
| Aqueous thiosulfate ammonium solution (700 g/L) | 240.0 mL |
| Ammonia water (27%) | 6.0 mL |
| Water to make | 1.0 L |
| pH (controlled by ammonia water and acetic acid) | 7.2 |

(Washing water)

Tap water was supplied to a mixed-bed column filled with an H-type strongly acidic cation exchange resin (Amberlite IR-120B: available from Rohm & Haas Co.) and an OH-Type strongly basic anion exchange resin (Amberlite IR-400) to set the concentrations of calcium and magnesium to be 3 mg/L or less. Subsequently, 20 mg/L of sodium isocyanuric acid dichloro and 150 mg/L of sodium sulfate were added. The pH of the solution ranged from 6.5 to 7.5

| (Stabilizer) | (unit: g) |
|---|---|
| Sodium p-toluene sulfinate | 0.03 |
| Polyoxyethylene p-monononylphenyl ether (average polymerization degree: 10) | 0.2 |
| Disodium ethylenediaminetetraacetate | 0.05 |
| 1,2,4-triazole | 1.3 |
| 1,4-bis(1,2,4-triazol-1-ylmethyl)piperazine | 0.75 |
| Water to make | 1.0 L |
| PH | 8.5 |

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide color photographic light-sensitive material comprising at least one red-sensitive silver halide emulsion layer, at least one green-sensitive silver halide emulsion layer, at least one blue-sensitive silver halide emulsion layer and at least one hydrophilic colloidal layer containing black colloidal silver on a support, wherein a ratio A/T of a coating amount A ($g/m^2$) of black colloidal silver in said hydrophilic colloidal layer to a dry film thickness T ($\mu m$) of said hydrophilic colloidal layer containing black colloidal silver is 0.25 to 6.

2. The silver halide color photographic light-sensitive material according to claim 1, wherein said hydrophilic colloidal layer containing black colloidal silver is disposed at closer position from the support than a color-sensitive layer next to the support among the red-sensitive silver halide emulsion layer, green-sensitive silver halide emulsion layer and blue-sensitive silver halide emulsion layer.

3. The silver halide color photographic light-sensitive material according to claim 1, which further contains an yellow coupler represented by Formula (I) below;

Formula (I)

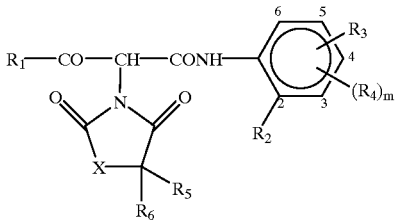

wherein $R_1$ represents a tertiary alkyl group, $R_2$ represents a halogen atom, an alkoxy group, an aryloxy group, an alkyl group, an alkylsulfonyloxy group or a cycloalkyl group, $R_3$ represents an alkoxycarbonyl group or an alkylsulfonyloxy group, $R_4$ represents a halogen atom, an alkyl group, an alkoxy group, a carbonamide group or a sulfonamide group, m represents an integer of 0 to 2, each of $R_5$ and $R_6$ independently represents a hydrogen atom or an alkyl group, X represents an oxygen atom, a sulfur atom or —N($R_{21}$)—, and $R_{21}$ represents a hydrogen atom, an alkyl group or an aryl group.

4. The silver halide color photographic light-sensitive material according to claim 2, which further contains an yellow coupler represented by Formula (I) below;

Formula (I)

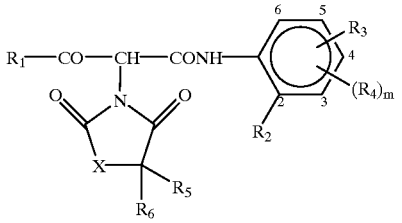

wherein $R_1$ represents a tertiary alkyl group, $R_2$ represents a halogen atom, an alkoxy group, an aryloxy group, an alkyl group, an alkylsulfonyloxy group or a cycloalkyl group, $R_3$ represents an alkoxycarbonyl group or an alkylsulfonyloxy group, $R_4$ represents a halogen atom, an alkyl group, an alkoxy group, a carbonamide group or a sulfonamide group, m represents an integer of 0 to 2, each of $R_5$ and $R_6$ independently represents a hydrogen atom or an alkyl group, X represents an oxygen atom, a sulfur atom or —N($R_{21}$)—, and $R_{21}$ represents a hydrogen atom, an alkyl group or an aryl group.

5. The silver halide color photographic light-sensitive material according to claim 1, wherein said ratio A/T is 0.3 to 6.

6. The silver halide color photographic light-sensitive material according to claim 3, wherein said yellow coupler represented by Formula (I) is a compound represented by Formula (III) below;

Formula (III)

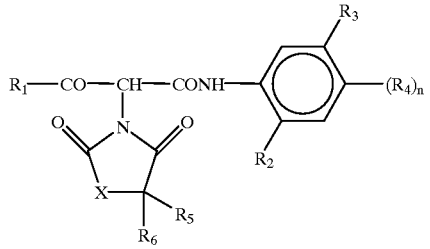

wherein $R_1$, $R_2$, $R_3$, $R_4$, $R_5$, $R_6$ and X are the same as in Formula (I) and n is an integer of 0 or 1.

7. The silver halide color photographic light-sensitive material according to claim 4, wherein said yellow coupler represented by Formula (I) is a compound represented by Formula (III) below, Formula (III)

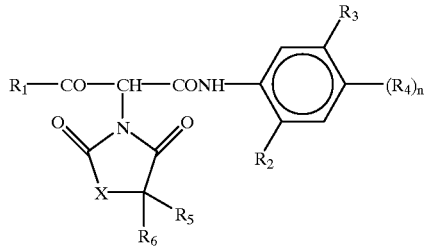

wherein $R_1$, $R_2$, $R_3$, $R_4$, $R_5$, $R_6$ and X are the same as in Formula (I) and n is an integer of 0 or 1.

* * * * *